US008746191B2

(12) United States Patent
Elfner et al.

(10) Patent No.: US 8,746,191 B2
(45) Date of Patent: Jun. 10, 2014

(54) TWO-STROKE ENGINE HAVING AN INTAKE ARRANGEMENT

(75) Inventors: Jörg Elfner, Leutenbach (DE); Fevronia Konstantinidou, Waiblingen (DE); Karsten Schmidt, Weinstadt (DE); Michael Raffenberg, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 264 days.

(21) Appl. No.: 13/423,074

(22) Filed: Mar. 16, 2012

(65) Prior Publication Data

US 2013/0228159 A1 Sep. 5, 2013

(30) Foreign Application Priority Data

Mar. 3, 2012 (DE) ..... 10 2012 004 322

(51) Int. Cl.

| | |
|---|---|
| ***F02B 25/00*** | (2006.01) |
| ***F02B 33/00*** | (2006.01) |
| ***F02B 33/04*** | (2006.01) |
| ***F02M 35/10*** | (2006.01) |
| ***F02B 43/00*** | (2006.01) |

(52) U.S. Cl.

USPC ... 123/65 R; 123/73 A; 123/73 C; 123/73 PP; 123/73 R; 123/429; 123/432; 123/433; 123/434; 123/525; 123/527; 123/184.21; 123/184.22; 123/184.25; 123/184.46; 123/184.47; 123/184.48

(58) Field of Classification Search

CPC ..... F02B 2075/025; F02B 1/04; F02B 31/08; F02B 63/02; F02M 35/1019; F02M 9/08

USPC ..... 123/65 R, 73 A, 73 PP, 73 R, 429, 432, 123/433, 434, 527, 525, 184.21–184.25, 123/184.46–184.48

See application file for complete search history.

(56) References Cited

U.S. PATENT DOCUMENTS

| | | | | |
|---|---|---|---|---|
| 6,101,991 | A * | 8/2000 | Glover | 123/73 PP |
| 7,513,225 | B2 * | 4/2009 | Geyer et al. | 123/73 A |

FOREIGN PATENT DOCUMENTS

DE 10 2006 014 991 A1 10/2007

* cited by examiner

*Primary Examiner* — Rinaldi Rada
*Assistant Examiner* — Tea Holbrook
(74) *Attorney, Agent, or Firm* — Walter Ottesen P.A.

(57) ABSTRACT

A two-stroke engine has an intake arrangement including a carburetor. An intake channel divides into a mixture channel and an air channel. An intermediate flange is mounted between the carburetor and the cylinder. This flange has a carburetor connecting surface, which faces toward the carburetor, and a cylinder connecting surface which faces toward the cylinder. Referred to the flow direction in the intake channel, the air channel divides upstream of the cylinder connecting surface into two branches. The first branch has a first longitudinal center axis and the second branch has a second longitudinal center axis. The intersect points of the center axes with the connecting surfaces are mutually connected via an imaginary connecting line in the carburetor connecting surface or the cylinder connecting surface. The two connecting lines conjointly define an angle β in the carburetor connecting surface with this angle being greater than 0°.

22 Claims, 14 Drawing Sheets

Fig. 1
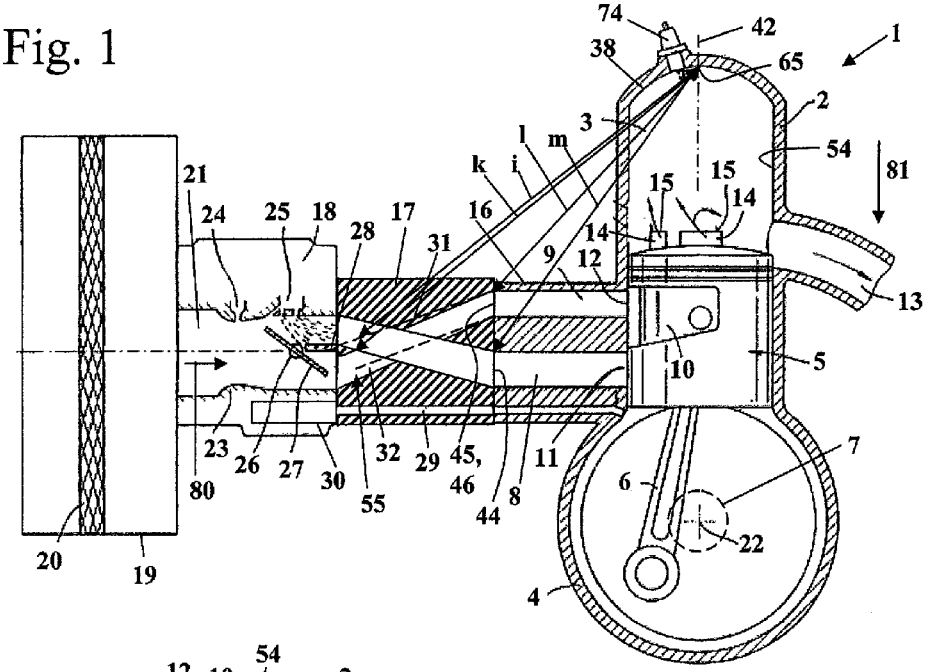
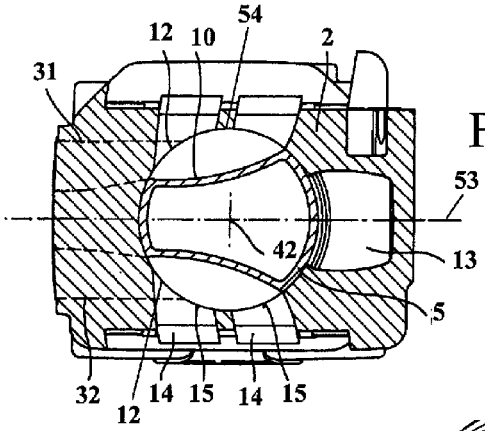
Fig. 2
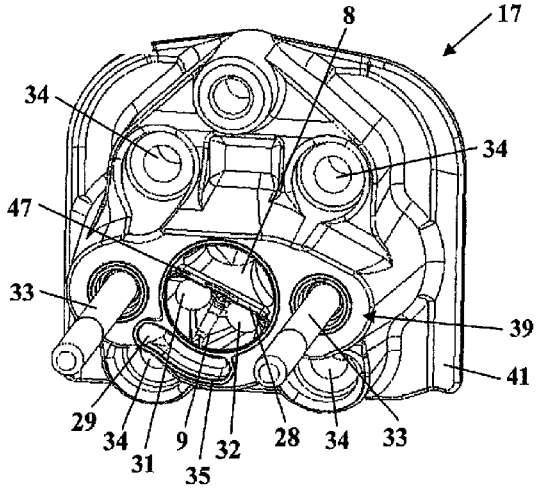
Fig. 3

Fig. 46
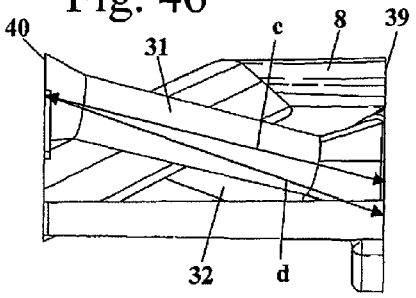
Fig. 47
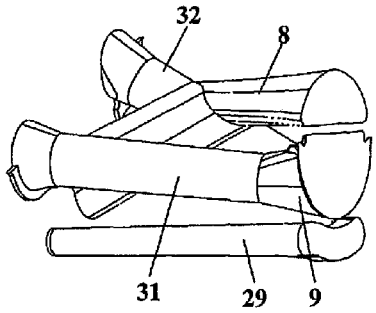
Fig. 48
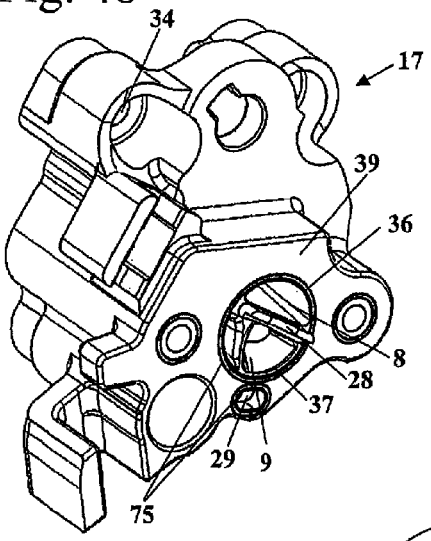
Fig. 49
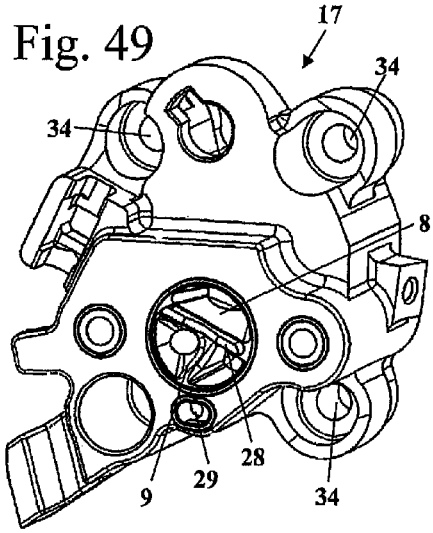
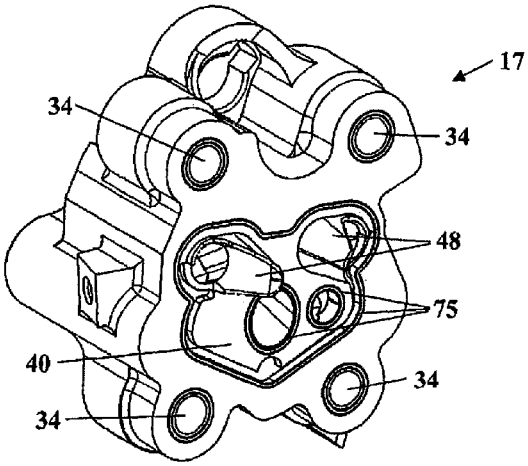
Fig. 50

Fig. 51
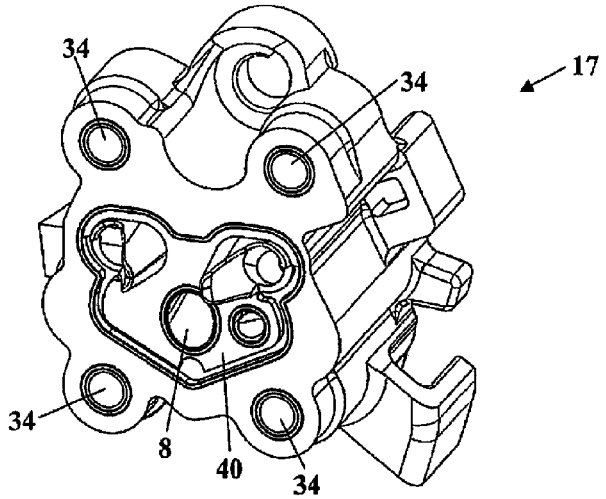
Fig. 52
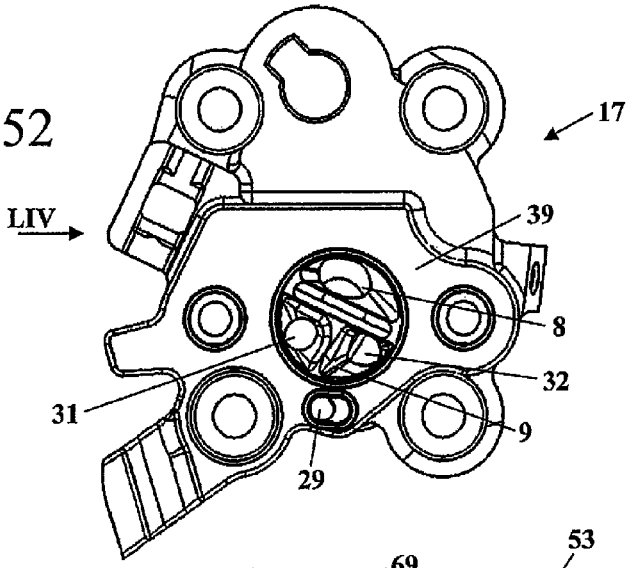
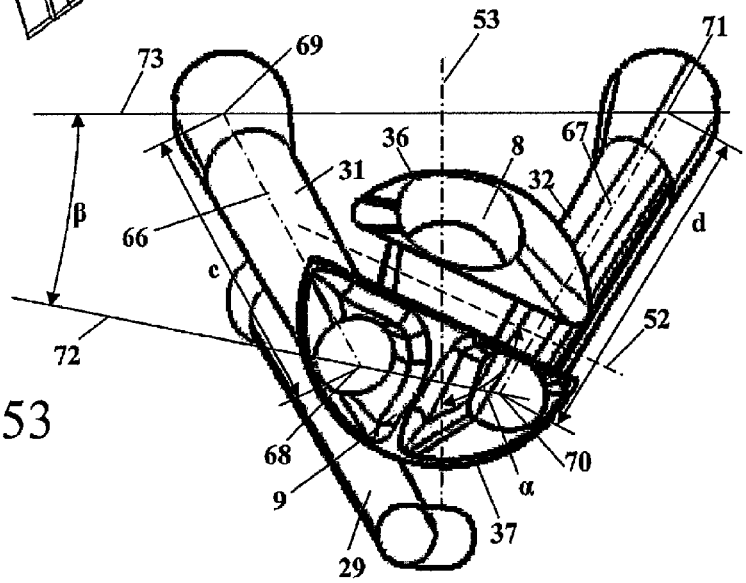
Fig. 53

TWO-STROKE ENGINE HAVING AN INTAKE ARRANGEMENT

CROSS REFERENCE TO RELATED APPLICATION

This application claims priority of German patent application no. 10 2012 004 322.8, filed Mar. 3, 2012, the entire content of which is incorporated herein by reference.

BACKGROUND OF THE INVENTION

From German patent publication 10 2006 014 991 A1, a two-stroke engine which draws in fuel and combustion air via a carburetor is known. Downstream of the carburetor, an air channel branches off from the intake channel and this air channel divides into two branches. These branches of the air channel run symmetrically to the center axis of the cylinder.

Two-stroke engines which operate with pre-stored scavenging are engines wherein substantially fuel-free air is pre-stored in the transfer channels and this pre-stored air pushes the exhaust gas out of the combustion chamber. In these two-stroke engines, a symmetrical arrangement is sought in order to achieve a symmetrical scavenging of the combustion chamber.

Two-stroke engines are, for example, used in hand guided work apparatus such as motor-driven chain saws, cut-off machines, brushcutters or the like. With the use of work apparatus of this kind, only limited structural space is available for the two-stroke engine.

SUMMARY OF THE INVENTION

It is an object of the invention to provide a two-stroke engine of the kind described above wherein the available structure space can be well utilized and with which a good combustion chamber scavenging during operation is obtained.

A two-stroke engine includes: a cylinder having a cylinder bore and defining a cylinder longitudinal axis; a piston mounted in the cylinder to move back and forth therein; the piston delimiting a combustion chamber formed in the cylinder; a crankcase connected to the cylinder; a transfer channel for connecting the crankcase to the combustion chamber at bottom dead center of the piston; an intake channel; an intake arrangement including a carburetor containing a portion of the intake channel; the intake channel dividing into a mixture channel and an air channel; the carburetor including a throttle element mounted therein for controlling the free flow cross section of the intake channel; an intermediate flange connecting the carburetor to the cylinder; the mixture channel and the air channel being guided in the intermediate flange; the intermediate flange having a carburetor connecting surface facing toward the carburetor and a cylinder connecting surface facing toward the cylinder; the air channel bifurcating into first and second branches in the intake channel upstream from the cylinder connecting surface referred to the flow direction in the intake channel; the first and second branches opening with respective air inlet openings at the cylinder bore; the first branch defining a first longitudinal center axis and the second branch defining a second longitudinal center axis; the first longitudinal center axis intersecting the carburetor connecting surface at a first intersect point and the cylinder connecting surface at a second intersect point; the second longitudinal center axis intersecting the carburetor connecting surface at a third intersect point and the cylinder connecting surface at a fourth intersect point; a first connecting line connecting the second intersect point with the fourth intersect point in the cylinder connecting surface; a second connecting line connecting the first intersect point with the third intersect point in the carburetor connecting surface; the first connecting line being projected perpendicularly onto the carburetor connecting surface to define a projected first connecting line; and, the projected first connecting line and the second connecting line conjointly defining an angle (β) greater than 0°.

To accommodate the two-stroke engine with an intake arrangement in the smallest possible structural space, it is provided that the two branches of the air channel do not run symmetrically but are inclined to each other. The branches of the air channel have longitudinal center axes. The longitudinal center axes are the connecting lines of the geometric center points of the cross section of the branch of the air channel. The cross sections lie perpendicular to the flow direction. If the branches of the air channel run in curves, then the longitudinal center axis is the line which approximately connects the center points of the cross sections. The longitudinal center axis is then the longitudinal center axis in a mid region of the branch of the air channel. Additional contours at the end regions of the branches of the air channel, for example, widened conical end regions, are not considered for determining the longitudinal center axis. The longitudinal axes each intercept a cylinder connecting surface and the carburetor connecting surface at intersect points. The connecting lines of the two intersect points in the carburetor connecting surface and the two intersect points in the cylinder connecting surface conjointly define an angle which is greater than 0°. The connecting lines accordingly do not run parallel to each other. If the carburetor connecting surface and the cylinder connecting surface do not run parallel to each other, then the angle between the two connecting lines is measured in the carburetor connecting surface. The connecting line in the cylinder connecting surface is, for this purpose, projected onto the carburetor connecting surface in a direction perpendicular to the carburetor connecting surface.

The intermediate flange is advantageously a compact component wherein the mixture channel, the air channel with its two branches and, advantageously, additionally a pulse channel are guided. The intermediate flange is advantageously a component which is stable as to form for the most part for the forces acting during operation. Advantageously, the intermediate flange comprises a form stable plastic. The intermediate flange can, however, also be an elastic component and be made of an elastic material such as elastomer or rubber.

The angle between the two connecting lines advantageously amounts to approximately 5° to approximately 60°. An angle of approximately 10° to approximately 40° has been shown to be especially advantageous. With an angle of approximately 10° to approximately 40° between the connecting lines, the carburetor can be positioned inclined at a corresponding angle on the carburetor connecting surface whereby the needed structural space is reduced.

Advantageously, the two branches of the air channel have a different average length from the carburetor connecting surface to the cylinder connecting surface. Surprisingly, it has been shown that a symmetrical combustion chamber scavenging can be achieved even for different lengths of the branches of the air channel and unsymmetrical channel guidance. In this way, a good scavenging of the combustion chamber is achieved as well as low exhaust gas values. Because of the different average lengths of the branches of the air channel, a free channel guidance is possible which is well adapted to the component space which is available. Advantageously, one branch of the air channel lies at its end closer to the combustion chamber roof center than the other branch. This end lies facing toward the carburetor connecting surface. The end, which lies facing toward the carburetor connecting flange, is that region of the branch of the air channel which lies directly downstream of the location whereat the air bifurcates into the two branches. In the branch, which has the greatest distance to the combustion chamber roof center, fuel can deposit which reaches the air channel from the mixture channel. This is when there is a perpendicular position of the cylinder longitudinal axis and when the combustion chamber is mounted above the crankcase. With the targeted collection of the fuel in one of the two branches, the entrainment of the fuel by the combustion air, which flows through the air channel, is supported so that fuel collections compared to symmetrical channel guidance can be reduced. In this way, a stable running performance of the two-stroke engine is achieved. The combustion chamber roof center is the intercept point of the cylinder longitudinal axis with the combustion chamber roof.

Advantageously, the air channel divides into the two branches in the intermediate flange. The air channel divides advantageously at a bifurcation into the two branches. The bifurcation has a distance to the carburetor connecting surface which is less than the distance of the bifurcation to the cylinder connecting surface. The distance of the bifurcation to the carburetor connecting surface advantageously amounts to less than half, especially less than a third of the distance of the bifurcation to the cylinder connecting surface. With the dividing of the air channel into the two branches close to the carburetor connecting flange, the two branches of the air channel can be guided past the mixture channel on both sides thereof.

Advantageously, at least one branch of the air channel has a flattened cross section next to the mixture channel. Because of the flattened cross section, the air channel can be guided past close to the mixture channel. In this way, a smaller assembly space of the entire arrangement results and the flow in the air channel need be less sharply deflected. The flattening of the branch of the air channel is advantageously provided at the side of the air branch which lies facing toward the mixture channel. The flattening is advantageously only provided in one of the two branches of the air channel. In this way, the two branches of the air channel are of different cross sectional courses.

Advantageously, the intake channel has an approximately circularly-shaped cross section at the carburetor connecting surface. In this way, a conventional carburetor can be used which has a circularly-shaped intake channel cross section. Advantageously, the intake channel divides into the air channel and the mixture channel at the carburetor connecting surface. It can, however, also be provided that the intake channel already divides into the air channel and the mixture channel within the carburetor. It can also be purposeful that the intake channel divides into the air channel and the mixture channel downstream of the carburetor connecting surface. Advantageously, an inlet window to the mixture channel and an inlet window to the air channel are provided in the carburetor connecting surface. The inlet window to the mixture channel advantageously lies closer to the combustion chamber roof center than the inlet window to the air channel. The flow cross section of the inlet window to the air channel is advantageously greater than the flow cross section of the inlet window to the mixture channel. With the increased flow cross section of the air channel, good exhaust gas values of the two-stroke engine are achieved. The inlet windows to the mixture channel and to the air channel are advantageously separated from each other in a partition plane. The partition plane and a center plane of the two-stroke engine, which contains the cylinder longitudinal axis and is symmetrical to the transfer channels, conjointly define an angle of less than 90°. The angle between the partition plane and the center plane advantageously amounts to approximately 50° to approximately 80°, especially from approximately 60° to approximately 70°. The partition of the air channel and mixture channel in the carburetor connecting surface can then also take place via a partition wall which is mounted on the carburetor or on an intermediate part between the carburetor and the intermediate flange.

Advantageously, the two branches of the air channel and the mixture channel open at three mutually separated outlet windows at the cylinder connecting surface. The outlet windows of the air channel and mixture channel are advantageously arranged symmetrically to the center plane. In this way, a symmetrical assembly of the cylinder of the two-stroke engine can be provided. The outlet windows from the two branches of the air channel then lie advantageously closer to the combustion chamber roof center than the outlet window from the mixture channel. In this way, the branches of the air channel can be connected to the transfer windows of the transfer channels via piston pockets in order to pre-store air in the transfer channels. The inlet window in the mixture channel lies closer to the combustion chamber roof center than the inlet window in the air channel and the outlet window from the two branches of the air channel lies closer to the combustion chamber roof center than the outlet window from the mixture channel. For this reason, the air channel can cross over the mixture channel in the intermediate flange. In this way, an advantageous arrangement of the carburetor is made possible. The branches of the air channel in the intermediate flange advantageously run on both sides of the mixture channel from the end of the mixture channel, which faces toward the crankcase, to the end of the mixture channel facing toward the combustion chamber. The arrangement is advantageously so designed that the two branches of the air channel are arranged in at least one section plane on both sides of the mixture channel. Accordingly, in the section plane transverse to the flow direction and viewed in flow direction, one branch of the air channel lies to the left of the mixture channel and the other branch of the air channel lies to the right of the mixture channel. In the region wherein the branches of the air channel are arranged next to the mixture channel, it is advantageous to provide a flattening at at least one of the branches of the air channel so that the air channel can be guided closely past the mixture channel. In this way, a simple manufacturing capability is achieved.

Advantageously, the outlet windows of the branches of the air channel lie with their upper ends, which lie facing toward the combustion chamber roof, in an imaginary plane which is at a distance to another imaginary plane wherein the upper end of the inlet window, which faces toward the combustion chamber roof, lies. This distance is 10% to 50%, especially from 20% to 30% of the diameter of the intake channel in the carburetor connecting surface. The imaginary planes run perpendicular to the carburetor connecting surface of the two-stroke engine. The imaginary plane, wherein the upper ends of the outlet windows from the air channel lie, advantageously has a distance to a plane wherein the upper ends of the inlet windows of the mixture channel, which face toward the combustion chamber roof, lie. This distance is less than 50% of the diameter of the intake channel in the carburetor connecting surface. Advantageously, the upper ends of the outlet windows of the air channel lie approximately in the same plane as the upper ends of the inlet windows in the mixture channel. The upper end of the inlet window into the mixture channel advantageously lies not above the upper ends of the outlet windows from the branches of the air channel. The plane, wherein the upper ends of the outlet windows from the air channel lie, advantageously is at a distance to the upper end of the outlet window of the mixture channel of approximately 50% to approximately 200% of the diameter of the intake channel in the carburetor connecting surface. The lower ends of the outlet windows from the air channel advantageously lie in a plane which has a distance to the upper end of the outlet windows of the mixture channel which amounts to less than approximately 20% of the diameter of the intake channel in the carburetor connecting surface. Advantageously, the distance amounts to approximately zero so that the lower ends of the outlet windows of the air channel lie in a same plane as the upper ends of the outlet window of the mixture channel.

Advantageously, in at least one end view transverse to the flow direction in the intake channel, especially perpendicular to the flow direction in the intake channel, at least one branch of the air channel and the mixture channel are guided in crossover. Side views identify the viewing direction wherein the channels appear in crossover. At least the longitudinal center axes of the channels cross over. Especially the channels cross completely so that one of the channels is guided from the lower end of the other channel in the crossover region into the above-mentioned side view at its upper end. In plan view therefore, in a viewing direction perpendicular to the above-mentioned side view, the channels run one next to the other.

Advantageously, a pulse channel is guided in the intermediate flange. In this way, no separate connecting line is needed for the pulse channel. The pulse channel advantageously connects the crankcase interior space to a fuel pump, which is mounted in the carburetor and is driven by the fluctuating crankcase pressure. A simple manufacturing capability is achieved when the pulse channel runs parallel to one of the branches of the air channel in the intermediate flange.

BRIEF DESCRIPTION OF THE DRAWINGS

The invention will now be described with reference to the drawings wherein:

FIG. 1 is a schematic longitudinal section through a two-stroke engine;

FIG. 2 is a section view through the cylinder of the two-stroke engine of FIG. 1 with the piston disposed at top dead center;

FIGS. 3 and 4 are perspective views of an intermediate flange of the two-stroke engine;

FIG. 46 is a side view of the channels formed in the intermediate flange;

FIG. 47 is a perspective view of the channels formed in the intermediate flange;

FIGS. 48 to 51 are perspective views of a further embodiment of the intermediate flange;

FIG. 52 is a side view of the intermediate flange of FIG. 48 from the carburetor connecting surface;

FIG. 53 is a side view of the channels shown in the view shown in FIG. 52 with the channels being guided in the intermediate flange of FIG. 48;

DESCRIPTION OF THE PREFERRED EMBODIMENTS OF THE INVENTION

Figure 4:
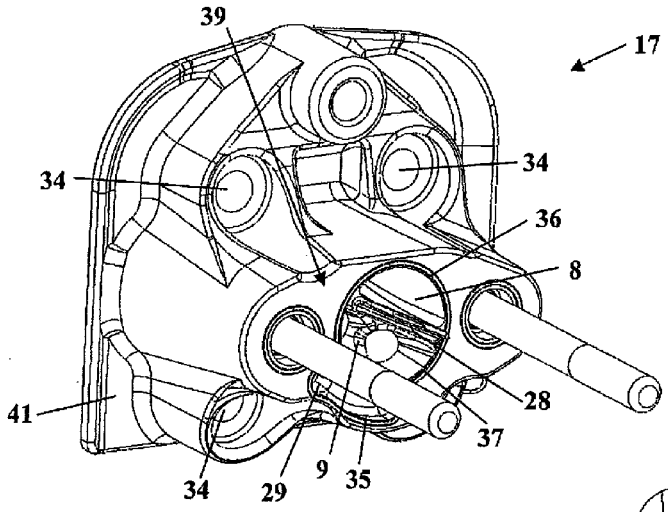

FIG. 1 shows a schematic of a two-stroke engine 1. The two-stroke engine 1 can, for example, be for driving a work tool in a hand-guided work apparatus such as a brushcutter, motor-driven chain saw, hedge trimmer, cutoff machine, lawn mower or the like. The two-stroke engine 1 has a cylinder 2 wherein a combustion chamber 3 is configured. The combustion chamber 3 is delimited by a piston 5 journalled so as to move back and forth in cylinder 2. The piston 5 drives a crankshaft 7 rotatably journalled in a crankcase 4. The piston 5 is connected to the crankshaft 7 via a connecting rod 6. The two-stroke engine 1 has an intake arrangement via which fuel and combustion air are drawn in. The intake arrangement includes an air filter 19 which has filter material 20 for separating out dirt from the combustion air. A carburetor 18 is arranged on the air filter 19 wherein a section of the intake channel 21 is formed. A main fuel opening 24 as well as several ancillary fuel openings 25 open into the intake channel 21 in the carburetor 18. The main fuel opening 24 opens at a venturi 23 configured in the intake channel 21. Throttle flap 27 with a throttle shaft 26 is pivotally journalled in the intake channel 21. The throttle flap 27 controls the free flow cross section of the intake channel 21. Combustion air flows through the intake channel in a flow direction 80 from the air filter 19 to the cylinder 2. A choke element, for example, a choke flap, is journalled in the intake channel 21 or in the air filter 19 ahead of the throttle flap 27 referred to the flow direction 80. The intake channel 21 divides into a mixture channel 8 and an air channel 9 downstream of the throttle flap 27. The air channel 9 further divides at a fork 55 into two branches 31 and 32 as will be described in greater detail hereinafter. The carburetor 18 has a fuel pump 30 which is driven by the fluctuating pressure in the crankcase 4. For this purpose, the fuel pump 30 is connected via a pulse channel 29 to the interior space of the crankcase 4.

The cylinder 2 has a cylinder connecting stub 16 which is connected to the carburetor 18 via an intermediate flange 17. In the embodiment, the intermediate flange 17 is fixed to the carburetor 18 with its end lying upstream and is fixed to the cylinder connecting stub 16 with its downstream lying end. However, it can be provided that, in addition to the intermediate flange 17, additional components can be arranged between carburetor 18 and cylinder connecting stub 16. In particular, a ring is arranged between carburetor 18 and intermediate flange 17 at a section of the partition wall and is especially configured as one piece with the ring. The partition wall separates the mixture channel 8 and the air channel 9 from each other.

The mixture channel 8 opens with a mixture inlet opening 11 on the cylinder bore 54 and the air channel 9 opens with an air inlet opening 12 on the cylinder bore 54. As FIG. 2 shows, each branch (31, 32) of the air channel 9 opens at the cylinder bore 54 with a separate air inlet opening 12. In the region of top dead center of the piston 5, the air inlet openings 12 are connected to the transfer windows 15 of transfer channels 14 via piston pockets 10 configured on the piston 5. The transfer channels 14 connect the interior space of the crankcase 4 to the combustion chamber 3 in the region of bottom dead center of piston 5. An outlet 13 for exhaust gases leads out of the combustion chamber 3.

During operation, an air/fuel mixture is drawn into the interior space of the crankcase 4 via the mixture channel 8 during operation in the region of top dead center of the piston 5. At the same time, substantially fuel-free combustion air flows into the transfer channels 14 via the air inlet openings 12 and the piston pockets 10 through the transfer windows 15. The combustion air, which is drawn via the air channel 9, can also contain fuel depending upon the operating state of the two-stroke engine. The mixture is compressed in the crankcase 4 during the downward stroke of the piston 5. As soon as the transfer windows 15 are opened by the piston 5, the substantially fuel-free combustion air, which is pre-stored in the transfer channels 14, flows into the combustion chamber 3. This substantially fuel-free combustion air flushes the exhaust gas out of the combustion chamber 3 via the outlet 13. Thereafter, mixture from the interior space of the crankcase 4 flows into the combustion chamber 3 via the transfer channels. The mixture in the combustion chamber 3 is compressed with the upward stroke of the piston 5 and is ignited by the spark plug 74 in the region of top dead center of the piston 5. The combustion in the combustion chamber 3 accelerates the piston 5 again back in the direction of crankcase 4. In the downward movement of the piston 5, the mixture is compressed in the crankcase 4 for the next engine cycle. As soon as the outlet 13 is opened by the piston 5, the exhaust gases flow out of the combustion chamber 3 and are flushed out of the combustion chamber 3 by the combustion air pre-stored in the transfer channels 14.

The piston 5 moves in the cylinder 2 in the direction of a cylinder longitudinal axis 42. In an assembly position, the cylinder longitudinal axis 42 can be aligned parallel to the operating direction 81 of the gravity force, for example, in a portable handheld work apparatus. The cylinder 2 is arranged above the crankcase 4. In the following, the designations "above" and "below" refer to the assembly position. The two-stroke engine 1 can, however, be built-in and operated in every suitable assembly position. The two-stroke engine 1 has a center plane 53 shown in FIG. 2. The center plane 53 contains the cylinder longitudinal axis 42 and bisects a rotational axis 22 of the crankshaft 7 at right angles. The branches 31 and 32 of the air channel 9 are configured to be symmetrical to the center plane 53 in the cylinder connecting stub 16. The air inlet openings 12 are also arranged symmetrically to the center plane 53. The branches 31 and 32 do not run symmetrically to the center plane 53 in the intermediate flange 17 as will be explained hereinafter.

As shown in FIGS. 1 and 3, on its end facing toward the carburetor, the intermediate flange 17 has an edge 28 in the intake channel 21 on which a support surface 47 is formed for the throttle flap 27. For a completely open throttle flap 27, the edge 28 partitions the air channel 9 from the mixture channel 8. Also, for a partially open throttle flap 27, only a narrow gap is formed between the edge 28 and the throttle shaft 26 so that only a slight quantity of fuel can arrive in the air channel 9.

FIGS. 3 and 4 show the intermediate flange 17 from the end facing toward the carburetor 18. The intermediate flange 17 has a carburetor connecting surface 39 whereat the air channel 9 and the mixture channel 8 open. The mixture channel 8 opens with an inlet window 36 at the carburetor connecting surface 39 and the air channel 9 opens with an inlet window 37 (FIG. 4). The pulse channel 29 opens at the carburetor connecting surface 39 with an inlet window 35.

As FIGS. 3 and 4 show, the intermediate flange 17 has, in total, four attachment openings 34 with which the intermediate flange 17 can be fixed to the cylinder 2. Two attachment bolts 33 project out from the intermediate flange 17 on which the carburetor 18 can be pushed and be fixed with corresponding attachment means, for example, attachment nuts.

Figure 5:
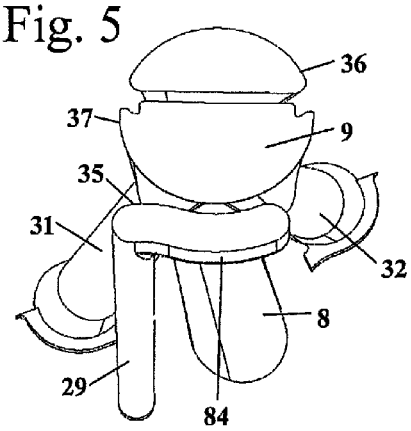
FIGS. 5 and 6 are perspective views of the channels guided in the intermediate flange of FIGS. 3 and 4.
Figure 6:
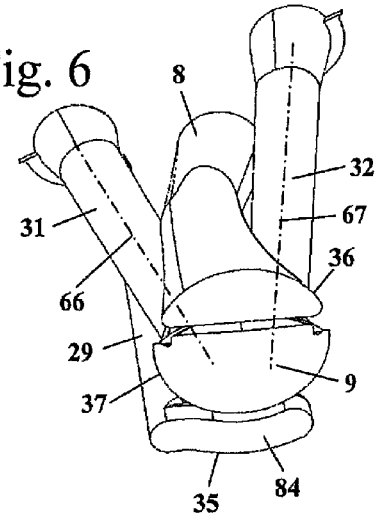

FIGS. 5 and 6 show the course of mixture channel 8 and air channel 9. The channels, which are guided in the intermediate flange 17, are shown as negative, that is, the hollow spaces of the intermediate flange 17, in which the channels are guided, are shown as full material and the material of the intermediate flange 17 is not shown. As FIGS. 5 and 6 show, the inlet window 35 of the pulse channel 29 is configured to be elongated. Next to the inlet window 35, the pulse channel 29 is guided with a section 84 on a section of the periphery of the inlet window 37 into the air channel 9. Via the inlet window 35, a connection with the connecting opening (not shown) of the fuel pump 30 in the carburetor 18 can be established in a simple manner. The connecting opening is arranged offset to the pulse channel 29.

As FIGS. 5 and 6 show, the air channel 9 divides into two branches 31 and 32 downstream of the inlet window 37 in the intermediate flange 17. The two branches 31 and 32 cross the mixture channel 8 and run on both sides of the mixture channel 8. On the end facing toward the carburetor, the mixture channel 8 is arranged on the upper end of the air channel 9 facing toward the cylinder 2. The branches 31 and 32 of the air channel 9 cross the mixture channel 8 and are arranged above the mixture channel at the end lying facing toward the cylinder. The characterization "above" refers to the upright arrangement of the two-stroke engine 1 shown in FIG. 1 wherein the cylinder longitudinal axis 42 is perpendicular, that is, aligned in the effective direction of gravity force and the crankcase 4 is arranged below the cylinder 2. As FIG. 6 shows, the first branch 31 of the air channel 9 has a longitudinal center axis 66 and the second branch 32 has a longitudinal center axis 67. The longitudinal center axes 66 and 67 connect the geometric center points of all cross sections of the branches 31 and 32 in the center region of the branches 31 and 32. On the end of the intermediate flange 17 which faces toward the cylinder 2, the branches 31 and 32 widen. This region is not considered for the longitudinal center axes 66 and 67. On the end facing toward the carburetor 18, the branches 31 and 32 likewise widen. Referred to the flow direction 80 downstream of the carburetor connecting surface 39, the two branches 31 and 32 are guided into a common air channel 9 next to the carburetor connecting surface 39 in the intermediate flange 17. Also, this common region of the two branches 31 and 32 is not considered for the longitudinal center axes 66 and 67.

Figure 7:
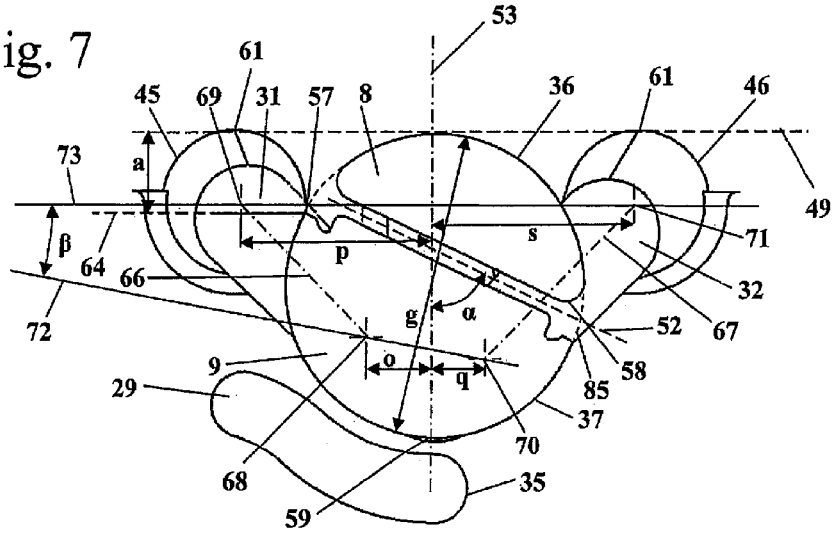
FIG. 7 is a side view of the channels guided in the intermediate flange.
Figure 8:
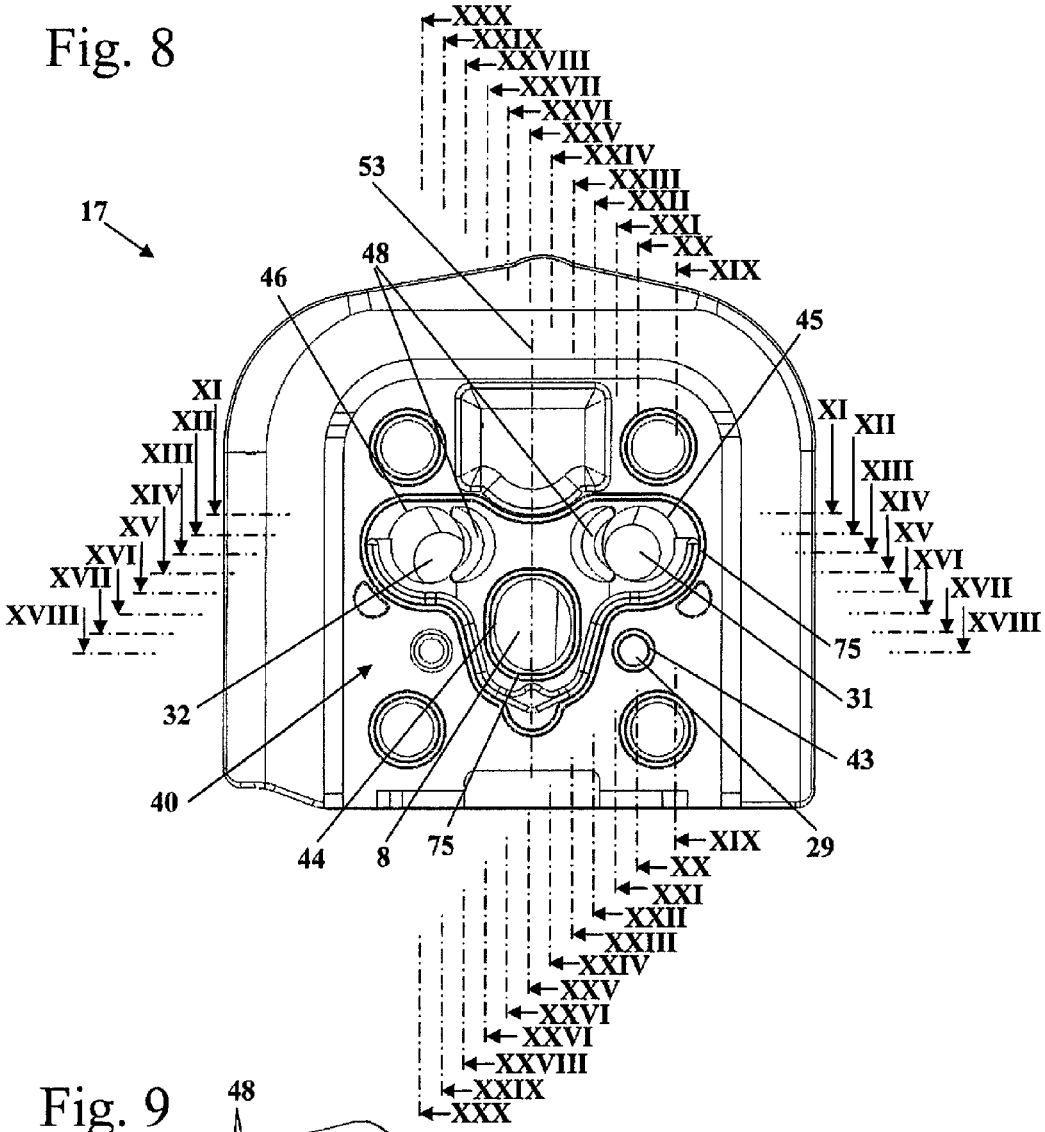
FIG. 8 is a side view of the intermediate flange from the end facing toward the cylinder.
Figure 9:
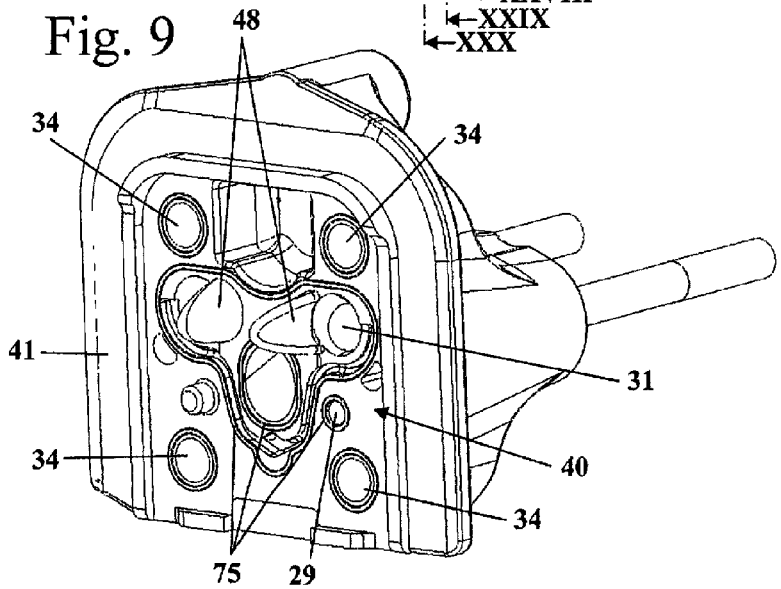
FIG. 9 is a perspective view of the intermediate flange.

As FIGS. 8 and 9 show, the intermediate flange 17 has a cylinder connecting surface 40 which, in the embodiment, lies against cylinder connecting stub 16 and is sealed off relative thereto. As FIG. 7 shows, the longitudinal center axis 66 intersects the carburetor connecting surface 39 with a first intercept point 68. The longitudinal center axis 66 of the first branch 31 intersects the cylinder connecting surface 40 at a second intercept point 69. The second longitudinal center axis 67 intercepts the carburetor connecting surface at a third intercept point 70. The second longitudinal center axis 67 intercepts the cylinder connecting surface 40 at a fourth intercept point 71. The two intercept points 68 and 70 lie on a first connecting line 72. The intercept points 69 and 71 lie on a second connecting line 73. The first connecting line 72 lies in the carburetor connecting surface 39 and the second connecting line 73 lies in the cylinder connecting surface 40. The two connecting lines 72 and 73 run at an angle to each other. In the end view shown in FIG. 7 and perpendicular to the carburetor connecting surface 39, the two connecting lines 72 and 73 conjointly define an angle β which is greater than 0°. The angle β advantageously lies in the range of approximately 5° to approximately 60° and especially in a range between approximately 10° to approximately 40°. The two branches 31 and 32 do not run symmetrically to each other or symmetrically to the center plane 53; instead, they are twisted relative to each other.

In the embodiment, the cylinder connecting surface 40 and the carburetor connecting surface 39 run parallel to each other and parallel to the cylinder longitudinal axis 42. It can, however, be advantageous that the carburetor connecting surface 39 is inclined relative to the cylinder connecting surface 40. An inclination of the carburetor connecting surface and/or the cylinder connecting surface to the cylinder longitudinal axis 42 can also be advantageous.

At the cylinder connecting surface 40, the first branch 31 opens with an outlet window 45 and the second branch 32 opens with an outlet window 46. The intake channel 21 has an approximately circularly-shaped outer periphery in the carburetor connecting surface 39 wherein the intake channel is divided into the inlet window 36 in the mixture channel 8 and the inlet window 37 in the air channel 9. The imaginary circle 85, which encloses the inlet windows 36 and 37 and which connects these windows to a circular surface, is shown by a broken line in FIG. 7. The inlet windows 36 and 37 are separated from each other by the edge 28 (FIG. 3). The partition plane 52 between the inlet windows 36 and 37 and the center plane 53 conjointly define an angle α of less than 90°. The angle α advantageously lies in a range from approximately 50° to approximately 80°, especially in a range of approximately 60° to approximately 70°. The intake channel 21 has a diameter (g) in the carburetor connecting surface 39. The diameter (g) is thereby the diameter of the imaginary circle 85. The upper end 61 of the outlet windows 45 and 46 lie in an imaginary plane 49. The plane 49 is a plane perpendicular to the carburetor connecting surface 39. The upper end 57 of the inlet window 37 in the air channel 9 lies in an imaginary plane 64. The plane 64 runs parallel to the plane 49. The plane 49 is at a distance (a) to the plane 64. The diameter (g) is significantly greater than the distance (a). Advantageously, the distance (a) amounts to approximately 10% to approximately 50% of the diameter (g) and amounts to especially from approximately 20% to approximately 30% of the diameter (g). The upper end 61 of the outlet windows 45 and 46 lies closer to the combustion chamber roof center 65 (FIG. 1) than the upper end 57. The combustion chamber roof center 65 is the intercept point of the cylinder longitudinal axis 42 with the combustion chamber roof 38 (FIG. 1). All upper ends of windows are the ends which face toward the combustion chamber roof 38 or the combustion chamber roof center 65. All lower ends of the inlet windows or outlet windows are those ends which lie facing away from the combustion chamber roof center 65 and lie facing toward the crankcase 4. If the cylinder longitudinal axis 42 is aligned in the effective direction 81 of gravitational force (FIG. 1) so that the cylinder 2 lies upwardly and the crankcase 4 lies downwardly, then the upper ends of the windows lie above and the lower ends of the windows lie below.

As FIG. 7 in combination with FIG. 1 shows, the lower end 58 of the inlet window 36 in the mixture channel 8 lies further from the combustion chamber roof center 65 than the upper end 57 of the inlet window 37 in the air channel 9. In FIG. 7, the lower end 59 of the inlet window 37 is shown in the air channel 9.

The first intercept point 68 lies at a distance (o) to the center plane 53 and the third intercept point 70 is at a distance (q) to the center plane 53. The distances (o, q) are measured perpendicularly to the center plane 53. The distances (o, q) each advantageously amount to approximately 10% to approximately 30% of the diameter (g). Advantageously, the distances (o) and (q) are of different size because of the unsymmetrical arrangement of the branches 31 and 32 of the air channel 9. The distances (o) and (q) are comparatively large, that is, the branches 31 and 32 of the air channel are connected comparatively far out to the common section of the air channel 9. For this reason, it is ensured that even for an inclined or a horizontal position of the cylinder 2, at most only a small quantity of fuel can collect in the region of the fork 55.

As FIG. 7 also shows, the second intercept point 69 is at a distance (p) to the center plane 53 and the fourth intercept point 71 has a distance (s) to the center plane 53. The distances (p, s) are likewise measured perpendicularly to the center plane 53. The distances (p) and (s) are approximately the same size. A smaller distance of the distances (p) and (s) results because of the different inclination of the longitudinal center axes 66 and 67 to the center plane 53. The outlet windows 45 and 46 are arranged symmetrically to the center plane 53. The distances (p) and (s) are significantly larger than distances (o) and (q). The distances (p) and (s) advantageously each amount to approximately twice to approximately five times of one of the distances (o) or (q). The branches 31 and 32 move away from the center plane 53 from the carburetor connecting surface 39 to the cylinder connecting surface 40. For this reason, it is ensured that, for an inclined or horizontal arrangement of the cylinder longitudinal axis 42, fuel, which has deposited in the air channel 9, runs to the cylinder 2 and cannot collect in the air channel 9.

FIGS. 8 and 9 show an intermediate flange 17 with a view toward the cylinder connecting surface 40. As FIG. 8 shows, the mixture channel 8 opens with outlet window 44 at the cylinder connecting surface 40. The pulse channel 29 opens with an outlet window 43 at the cylinder connecting surface 40. The section 84 of the pulse channel 29, which is likewise shown in FIG. 10, runs on the carburetor connecting surface 39. Flow conducting walls 48 are provided next to the outlet windows 45 and 46 from the two branches 31 and 32 of the air channel 9 at the end of the outlet windows 45 and 46 facing toward the center plane 53. The flow conducting walls 48 project into the cylinder connecting stub 16. The flow conducting walls 48 delimit the branches 31 and 32 of the air channel in the cylinder connecting stub 16. A part of the branches 31 and 32 in the cylinder connecting stub 16 are delimited by intermediate flange 17. For this reason, the branches 31 and 32 can be easily manufactured in the cylinder connecting stub 16. An advantageous de-molding arrangement can be achieved in a casting method during manufacture. As FIGS. 8 and 9 also show, the outlet windows (43, 44, 45, 46) are surrounded by sealing edges 75. The sealing edges 75 can be configured as seals or serve as a recess which can accommodate a separate seal. The seal edges 75 separate the mixture channel 8, the air channel 9 and the pulse channel 29 from one another. No seal edge 75 is provided between the outlet openings 45 and 46 from the two branches 31 and 32 of the air channel 9.

Figure 10:
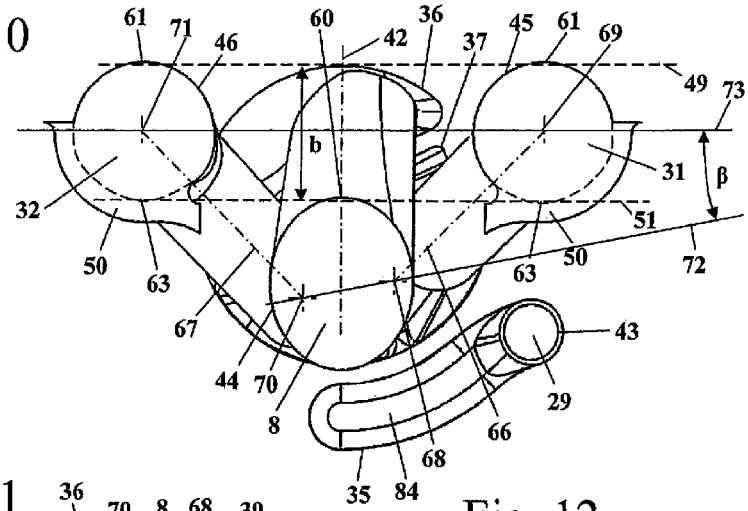
FIG. 10 is a side view from the end facing toward the cylinder onto the channels configured in the intermediate flange.

FIG. 10 shows the position of the longitudinal center axes 66 and 67 and the intercept points 69 and 71. Also, the position of the intercept points 68 and 70 is shown. In the embodiment, the cylinder connecting surface 40 and the carburetor connecting surface 39 run parallel so that also in the view shown in FIG. 10, the angle β between the connecting lines 72 and 73 can be seen perpendicular to the cylinder connecting surface 40. When the carburetor connecting surface 39 and the cylinder connecting surface 40 run inclined to each other, then there results the angle β in the projection of the connecting line 73 in the carburetor connecting surface 39 and with a projection perpendicular to the carburetor connecting surface 39. The outlet window 44 from the mixture channel 8 has an upper end 60 which lies in an imaginary plane 51. The plane 51 is also arranged perpendicularly to the carburetor connecting surface 39. The plane 51 runs parallel to the plane 49. The imaginary plane 51 lies further remote from the combustion chamber roof center 65 (FIG. 1) than the imaginary plane 49 wherein the upper ends 61 of the outlet windows 45 and 46 lie. The imaginary plane 51 is at a distance (b) to the plane 49 and this distance is approximately 50% to approximately 200% of the diameter (g) of the intake channel 21 in the carburetor connecting surface 39. Advantageously, the lower ends 63 of the outlet windows 45 and 46 likewise lie approximately in the imaginary plane 51. The distance of the lower ends 63 of the outlet windows 45 and 46 to the imaginary plane 51 advantageously amounts to less than approximately 25% of the diameter of the intake channel 21. As FIG. 10 shows, the mixture channel 8 intersects the plane 51. The inlet window 36 (FIG. 7) in the mixture channel 8 lies, for the most part, above the plane 51. As FIG. 10 shows, also the branches 31 and 32 of the air channel 9 intersect the plane 51. The inlet window 37 in the air channel 9 lies, for the most part, below the plane 51.

Figure 11:
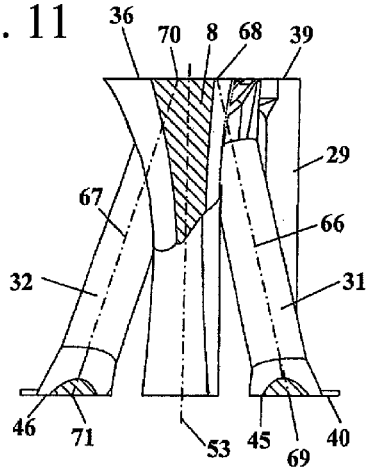
FIGS. 11 to 30 are respective section views through the channels along the section line shown in FIG. 8 with these channels being configured in the intermediate flange.
Figure 12:
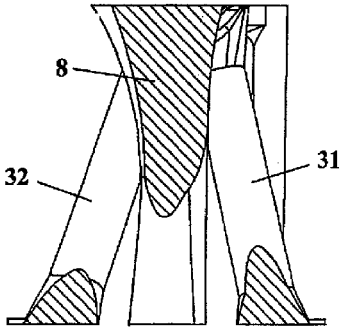
Figure 13:
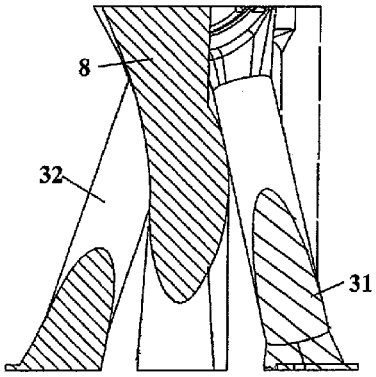

FIGS. 11 to 18 show longitudinal sections through the intermediate flange 17. The channels 8, 9 and 29 are shown as full material; whereas, the material of the intermediate flange 17 is not shown at all. In FIG. 11, the longitudinal center axes 66 and 67 of branches 31 and 32 of the air channel 9 are shown with their intersect points 68 to 71. As FIGS. 11 to 13 show, the mixture channel 8 lies above the air channel 9 at the carburetor connecting surface 39. The branches 31 and 32 of the air channel 9 lie above the mixture channel 8 at the cylinder connecting surface 40. The mixture channel 8 and the branches 31 and 32 of the air channel 9 are guided in crossover in the intermediate flange 17 in accordance with a lateral view, that is, in a viewing direction perpendicular to the center plane 53 or in a view direction approximately perpendicular to the flow direction 80 (FIG. 1).

Figure 14:
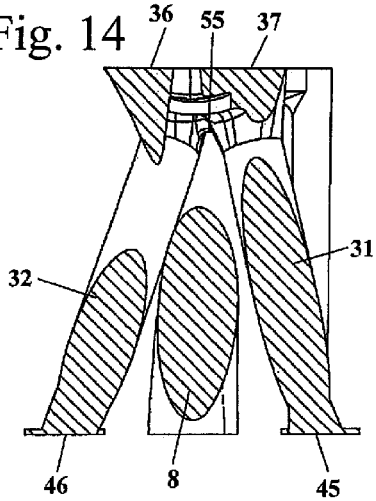
Figure 15:
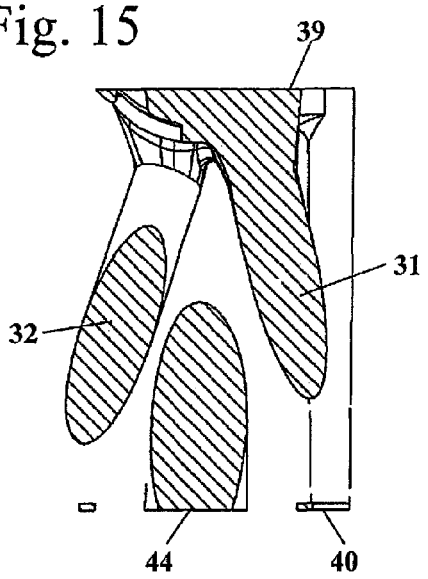
Figure 16:
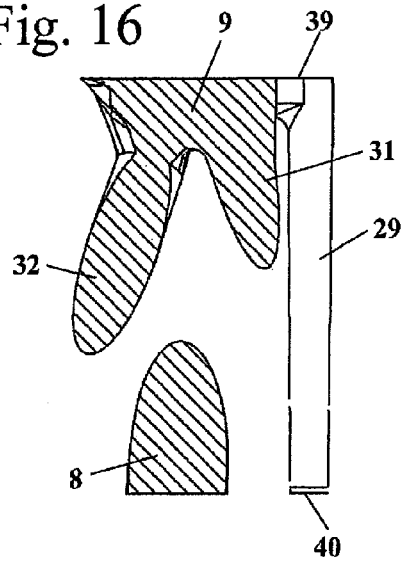
Figure 17:
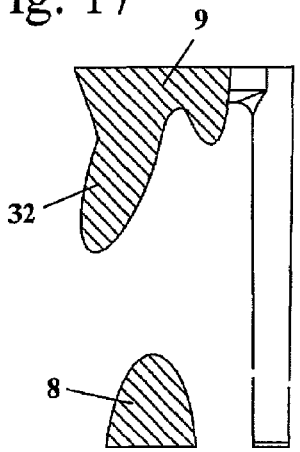
Figure 18:
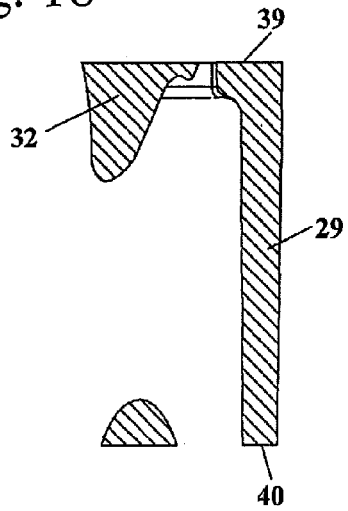
Figure 19:
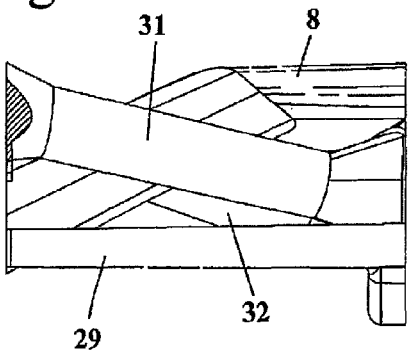
Figure 20:
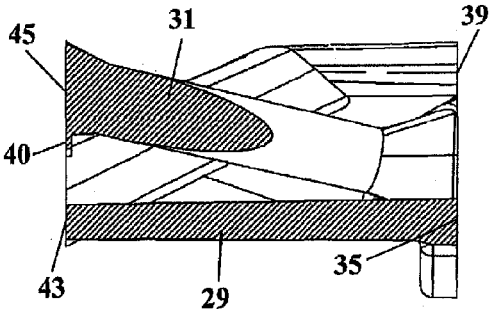
Figure 21:
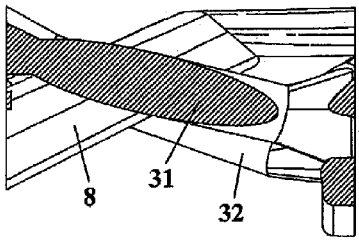
Figure 22:
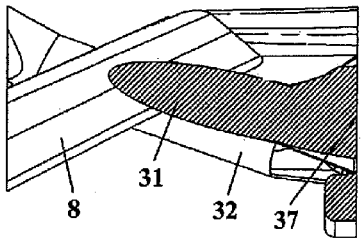
Figure 23:
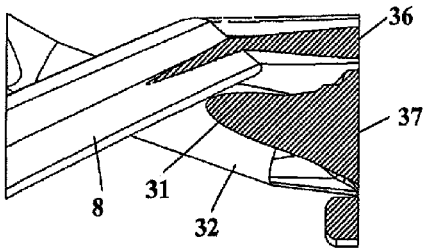

As shown especially in FIG. 14, the two branches 31 and 32 lie in a center region of the intermediate flange 17 on both sides of the mixture channel 8. Referred to a viewing direction in flow direction 80, one branch 31 lies to the left of the mixture channel 8 and the other branch 32 lies to the right of mixture channel 8. As FIGS. 15 and 16 show, the first branch 31 of the air channel 9 lies next to the carburetor connecting surface 39 above the second branch 32. This is shown also in FIGS. 17 and 18. In the section shown in FIG. 18, the first branch 31 is no longer visible; whereas, the second branch 32 is still shown partially in section. As the figures also show, the pulse channel 29 runs approximately perpendicularly to the carburetor connecting surface 39 and the cylinder connecting surface 40. The pulse channel 29 does not run parallel to any of the channels (8, 9, 31, 32) in the intermediate flange 17. Since all other channels (8, 9, 31, 32) run inclined to the carburetor connecting surface 39 and to the cylinder connecting surface 40, the pulse channel 29 has the shortest length of the channels formed in the intermediate flange 17. Advantageously, the pulse channel 29 runs perpendicularly to at least one connecting surface (39, 40).

Figure 24:
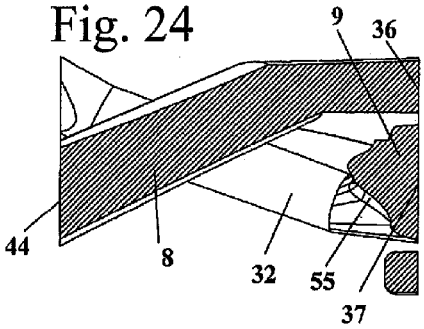
Figure 25:
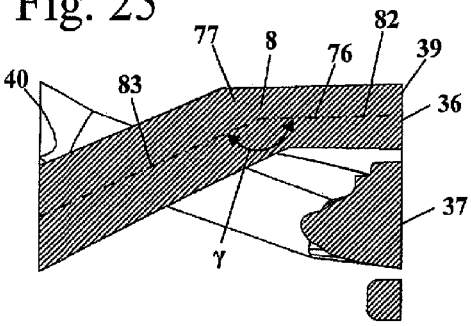
Figure 26:
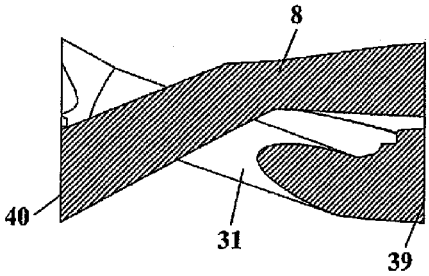
Figure 27:
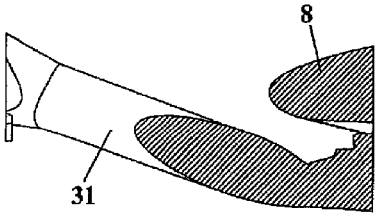
Figure 28:
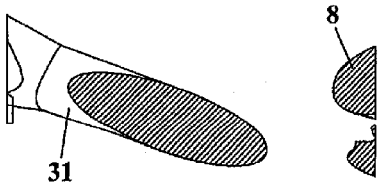
Figure 29:
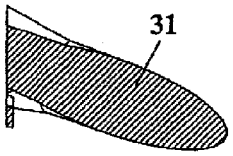
Figure 29:
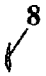
Figure 30:
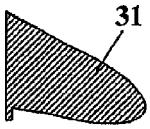

FIGS. 19 to 30 show longitudinal sections through the intermediate flange 17. Here too, the channels, that is, air spaces in the intermediate flange 17, are shown and the intermediate flange 17 itself is not shown. The pulse channel 29 runs on the cylinder connecting surface 40 approximately below the outlet window 45 from the first branch 31 of the air channel 9. As FIGS. 20 to 23 show, the first branch 31 runs inclined relative to the center plane 53 (FIG. 11) from the cylinder connecting surface 40 to the carburetor connecting surface 39. The first branch 31 removes itself from the center plane 53 from the carburetor connecting surface 39 to the cylinder connecting surface 40. In the side view shown, the first branch 31 crosses the mixture channel 8. The first branch 31 is partially arranged below the mixture channel 8 at the inlet window 37. As FIGS. 24 and 25 show, the air channel 9 forks at a bifurcation 55 into the two branches 31 and 32. The bifurcation 55 is configured directly below the mixture channel 8. As FIGS. 26 to 30 show, the second branch 31 moves away from the center plane 53 (FIG. 11) from the carburetor connecting surface 39 to the cylinder connecting surface 40. As shown especially in FIGS. 25 and 26, the mixture channel 8 runs kinked. The mixture channel has a kink 77. The mixture channel 8 has a longitudinal center axis 76 which likewise runs with a kink. Next to the carburetor connecting surface 39, the mixture channel 8 runs approximately perpendicular thereto. A first segment 82 of the longitudinal center axis 76 is arranged in this region. The mixture channel 8 runs at an angle next to the cylinder connecting surface 40. In this region, a second segment 83 of the longitudinal center axis 76 is arranged. The two segments 82 and 83 of the longitudinal center axis 76 conjointly define an angle γ which is between 90° and 180°. Advantageously, the angle γ lies in a range of approximately 140° to approximately 170°.

Figure 31:
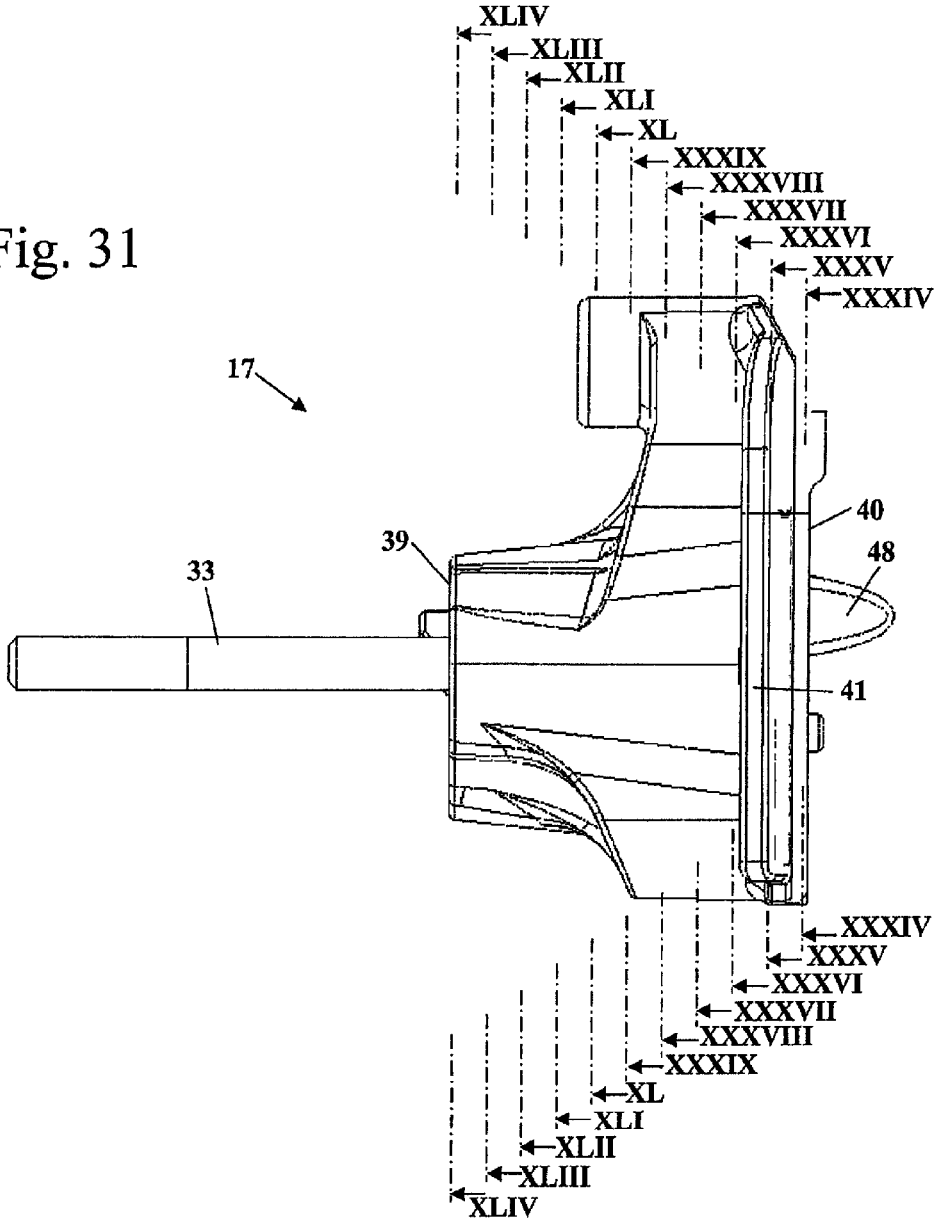
FIG. 31 is a side view of the intermediate flange.

FIGS. 3 and 4 as well as FIG. 31 show a shielding wall 41 of the intermediate flange 17. The shielding wall 41 forms an extension of the cylinder connecting surface 40. The shielding wall 41 functions to provide a better thermal separation of the cylinder 2 from the intake arrangement.

Figure 32:
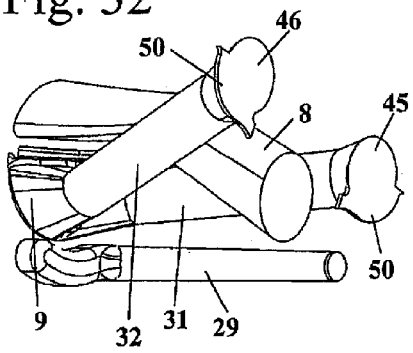
FIG. 32 is a perspective view of the channels configured in the intermediate flange.

In FIG. 32, the branches 31 and 32 of the air channel 9 are shown perspectively with the outlet windows 45 and 46 and with cutouts 50. The cutouts 50 are described in greater detail hereinafter.

Figure 33:
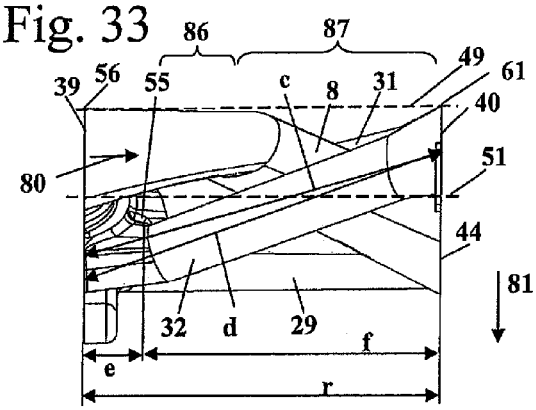
FIG. 33 is a side view of the channels configured in the intermediate flange.
Figure 34:
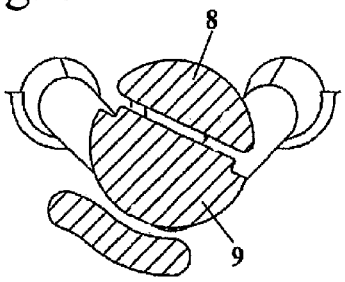
FIGS. 34 to 44 are section views through the channels along the section line shown in FIG. 31 with the channels being configured in the intermediate flange.

FIG. 33 shows the channels of the inte/mediate flange 17 in the position of the intermediate flange 17 shown in FIG. 31, that is, in a side view perpendicular to the center plane 53 and perpendicular to the flow direction 80 (FIG. 1). As FIG. 33 shows, the bifurcation 55 to the carburetor connecting surface 39 has a distance (e) which is significantly less than the distance (f) of the bifurcation 55 to the cylinder connecting surface 40. The distance (e) advantageously amounts to less than half, especially less than one third, of the distance (f). The distance (e) is measured perpendicularly to the carburetor connecting surface 39 and the distance (f) is measured perpendicularly to the cylinder connecting surface 40. As FIG. 33 also shows, the intermediate flange 17 has a width (r). The width (r) advantageously amounts to approximately half to five times the diameter (g) of the intake channel 21 (FIG. 7). The imaginary plane 49 is also shown in FIG. 33. In this plane 49, the upper end 61 of the outlet windows 45 and 46 from the branches (31, 32) of the air channel 9 and the upper end 56 of the inlet window 36 lie in the mixture channel 8.

As the side view in FIG. 33 shows, the two branches (31, 32) of the air channel 9 and of the mixture channel 8 are guided in crossover. Here, the two branches (31, 32) need not run crossover with the mixture channel 8. It can also be advantageous to guide only one of the branches 31 and 32 in crossover to the mixture channel 8. In FIG. 33, the mixture channel 8 at the carburetor connecting surface 39 is arranged for the most part above the air channel 9 referred to the effective direction 81 of gravitational force for a cylinder longitudinal axis 42 arranged perpendicularly and, at the cylinder connecting surface 40, the mixture channel 8 is arranged below the branches 31 and 32 of the air channel 9. In a first region 86 between the connecting surfaces 39 and 40, which lies downstream of the bifurcation 55, the mixture channel 8 is arranged completely above the branches 31 and 32 of the air channel 9. In a second region 87, which is arranged between the first region 86 and the cylinder connecting surface 40, the branches 31 and 32 cross the mixture channel 8. The mixture channel 8 as well as the branches (31, 32) of the air channel 9 intersect the imaginary plane 51. The outlet windows 45 and 46 are arranged completely above the plane 51 at the cylinder connecting surface 40 and the outlet window 44 from the mixture channel 8 is arranged completely below the plane 51.

Figure 35:
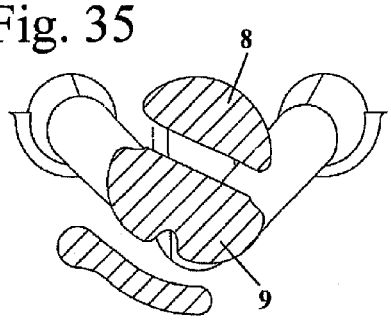
Figure 36:
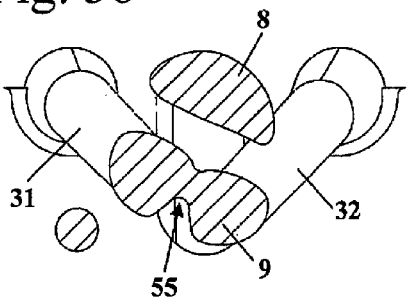

FIGS. 34 to 44 show the course of the channels 8 and 9 in sections parallel to the cylinder connecting surface 40 (FIG. 31). As FIGS. 35 and 36 show, the air channel divides gradually at the bifurcation 55 (FIG. 36) into the two branches 31 and 32. As FIG. 36 shows, the second branch 32 lies lower in the region of the bifurcation 55 than the first branch 31 when the cylinder longitudinal axis 42 of the two-stroke engine 1 is aligned parallel to the working direction 81 of the gravitational force (FIG. 1) and the cylinder 2 is arranged above the crankcase 4. For this position of the two-stroke engine, fuel therefore which passes from the mixture channel 8 into the air channel 9 collects mostly in the second branch 32 and can therefore better be entrained by the combustion air flowing through the air channel 9. As FIG. 1 shows, at the bifurcation 55, the first branch is at a distance (i) to the combustion chamber roof center 65 which is less than a distance (k) of the second branch 32 to the combustion chamber roof center 65. The distances (i) and (k) are each measured from the upper end of the branches 31 and 32 directly downstream of the bifurcation 55.

Figure 37:
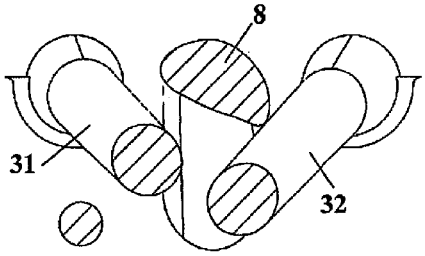
Figure 38:
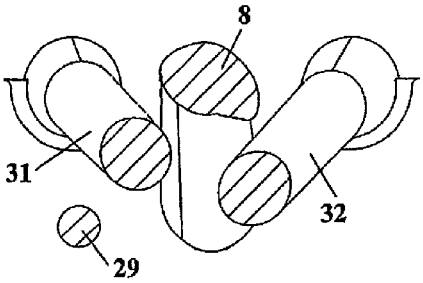
Figure 39:
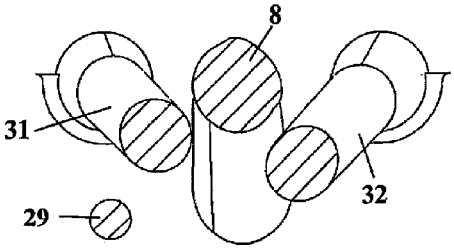
Figure 40:
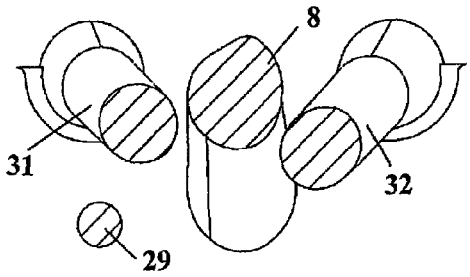
Figure 41:
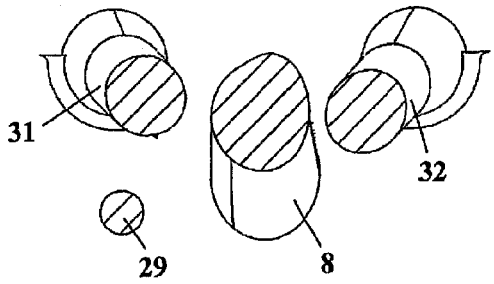
Figure 42:
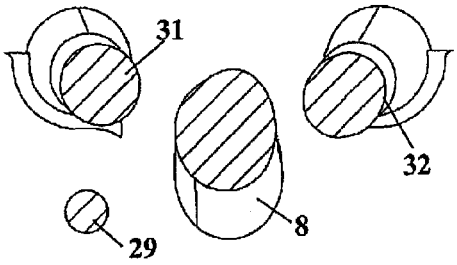
Figure 43:
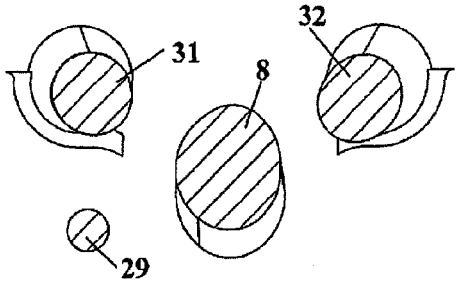
Figure 44:
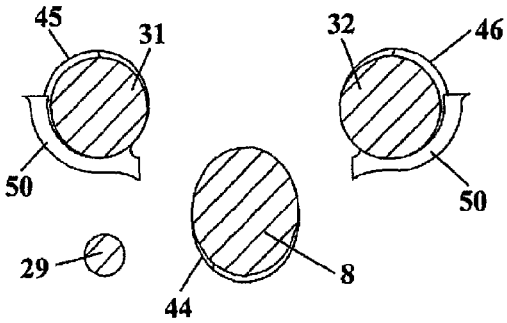
Figure 45:
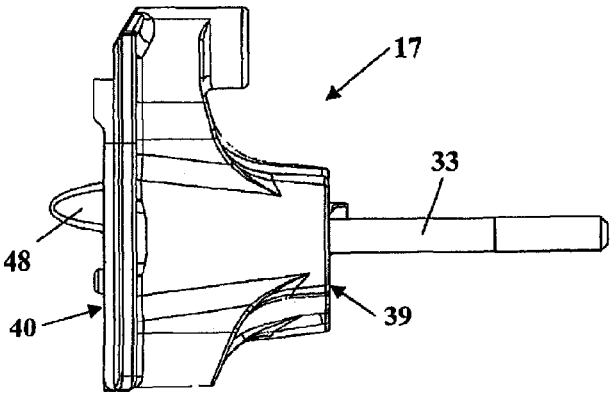
FIG. 45 is a side view of the intermediate flange.

As FIGS. 37 to 39 show, the mixture channel 8 runs from an elongated half-circularly-shaped section (FIG. 34), passing more and more into an approximately circularly-shaped section. The branches 31 and 32 of the air channel 9 also pass into a circularly-shaped cross section after the bifurcation 55. As FIGS. 34 to 43 show, the branches 31 and 32 widen next to cylinder connecting surface 40. This widened region is not considered in the determination of the course of the longitudinal center axes 66 and 67 (FIG. 10). As FIG. 44 shows, cutouts 50 are formed next to the outlet windows 45 and 46 of the branches 31 and 32 of air channel 9. The cross section is increased at the cutouts 50. The depth of the cutouts 50, that is, the extent of the cutouts perpendicular to the cylinder connecting surface 40, is very slight. As FIG. 10 shows, the cutouts 50 are not considered in the determination of the position of the lower ends 63 of the outlet windows 45 and 46. As FIG. 44 also shows, the outlet windows 45 and 46 are arranged above the outlet window 44 from the mixture channel 8 at the cylinder connecting surface 40. As FIG. 1 shows in combination with FIG. 44, the outlet windows (45, 46) have a distance (l) to the combustion chamber roof center 65 which is greater than the distance (m) of the outlet window 44 to the combustion chamber roof center 65. The distances (l) and (m) are therefore each measured to the upper end 60 and 61 of the outlet windows (44, 45, 46).

FIGS. 46 and 47 also show the course of the mixture channel 8 and the two branches 31 and 32 of the air channel 9. As FIG. 46 shows, the first branch 31 has a center length (c) which is less than the average length (d) of the second branch 32. The different center lengths of the branches 31 and 32 result from the unsymmetrical arrangement of the two branches 31 and 32 to the center plane 53. The center length (c) and the center length (d) are measured from the carburetor connecting surface 39 to the cylinder connecting surface 40 on the respective longitudinal axes 66 and 67 (FIG. 10).

FIGS. 48 to 62 show a further embodiment of an intermediate flange 17. The same reference numerals are used to characterize corresponding elements as in the previous figures. An air channel 9 and a mixture channel 8 are guided in the intermediate flange 17. Next to the carburetor connecting surface 39, the intermediate flange 17 has an edge 28 which partitions the inlet window 36 in the mixture channel 8 from the inlet window 37 in the air channel 9. The intermediate flange 17 has four attachment openings 34 whereat the intermediate flange can be fixed to the cylinder 2.

FIG. 53 shows the course of the channels in the intermediate flange 17, namely, the course of mixture channel 8, air channel 9 with its two branches 31 and 32 and the course of the pulse channel 29. As FIG. 53 shows, the partition plane 52 between the inlet windows 36 and 37 defines an angle $\alpha$ with the center plane 53 which is less than 90°, especially approximately 50° to approximately 80°, preferably from approximately 60° to approximately 70°. The first branch 31 has a longitudinal center axis 66 and the second branch 32 has a longitudinal center axis 67. The longitudinal center axis 66 intersects the carburetor connecting surface 39 (FIG. 39) at a first intersect point 68 and the cylinder connecting surface 40 (FIG. 51) at a second intersect point 69. The second longitudinal center axis 67 intersects the carburetor connecting surface 39 at a third intersect point 70 and the cylinder connecting surface 40 intersects at a fourth intersect point 71. The connecting line 72 of the intersect points 68 and 70 defines an angle $\beta$ with the connecting line 73 of the intersect points 69 and 71 in the carburetor connecting surface 39. The angle $\beta$ is greater than 0°. The angle $\beta$ advantageously is approximately 5° to approximately 60°, especially from approximately 10° to approximately 40°. The line 72 lies in the carburetor connecting surface 39 and the line 73 lies in the cylinder connecting surface 40. The lines 72 and 73 run askew to each other.

Figure 54:
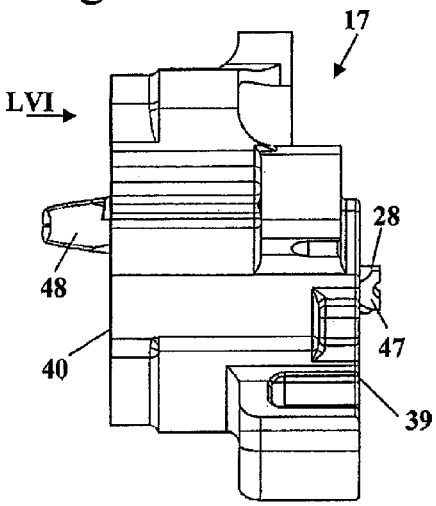
FIG. 54 is a side view of the intermediate flange viewed in the direction of arrow LIV of FIG. 52.
Figure 55:
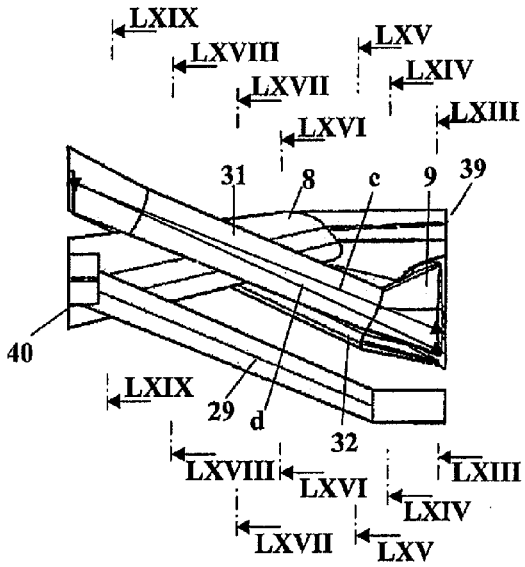
FIG. 55 is a side view of the channels shown in the view shown in FIG. 54 with the channels being configured in the intermediate flange of FIG. 48.
Figure 56:
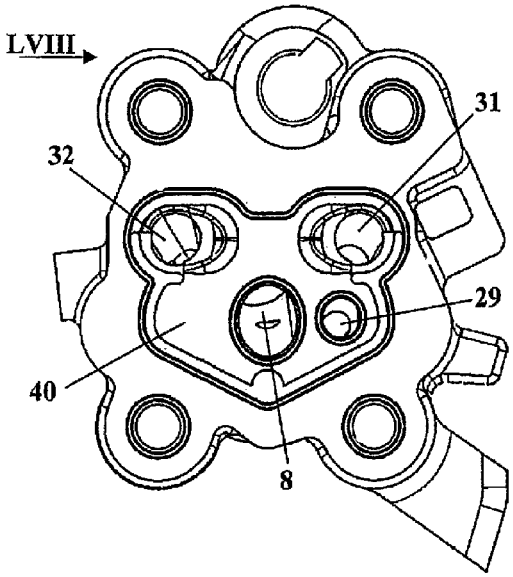
FIG. 56 is a side elevation view toward the intermediate flange in the direction of arrow LVI in FIG. 54.
Figure 59:
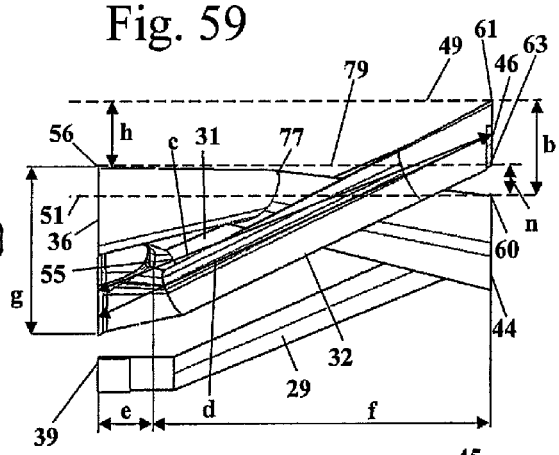
FIG. 59 is a side view of the channels shown in the view shown in FIG. 58 with the channels being configured in the intermediate flange of FIG. 48.

FIG. 54 shows the intermediate flange 17 in a side view. FIG. 55 shows the course of mixture channel 8, air channel 9 and pulse channel 29 in the position of the intermediate flange 17 shown in FIG. 54. FIG. 59 shows the channels from the opposite-lying side, namely, in the position of the intermediate flange 17 shown in FIG. 58. In FIG. 59, the second branch 32 is clearly visible. As FIGS. 55 and 59 show, the second branch 32 has an average length (d) which is somewhat greater than the average length (c) of the first branch 31. The pulse channel 29 runs approximately parallel to the first branch 31. In this way, the pulse channel 29 and the first branch 31 of the air channel 9 have approximately the same average length. In this way, the intermediate flange 17 is more easily produced. The mixture channel 8 runs with a kink. The kink 77 of the mixture channel 8 is further away from the carburetor connecting surface 39 than the bifurcation 55 (FIG. 59).

Figure 60:
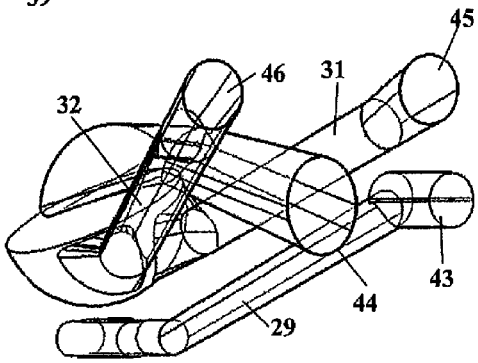
FIGS. 60 to 62 are perspective views of the channels configured in the intermediate flange of FIG. 48; and, FIGS. 63 to 69 are section views taken through the channels configured in the intermediate flange along the section lines shown in FIG. 55.
Figure 61:
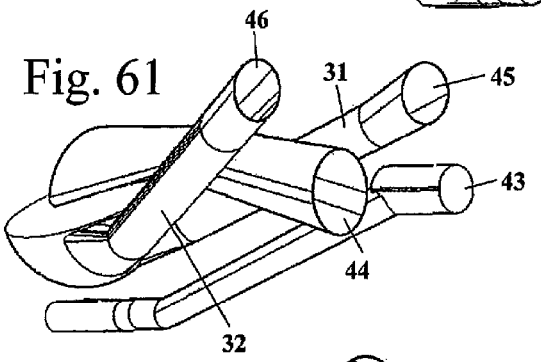
Figure 62:
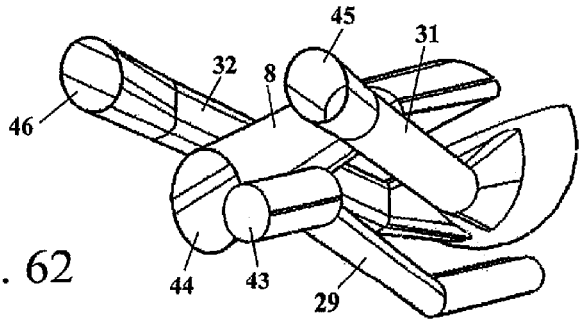

As FIGS. 60 to 62 in combination with FIG. 1 show, the second branch 32 next to the carburetor connecting surface 39 is partially lower, that is, at a greater distance to the combustion chamber roof center 65 than the first branch 31 so that fuel, which reaches the air channel 9, is collected in the most part in branch 32. In FIGS. 60 to 62, the windows 43 to 46 from the channels are shown. The second branch 32 winds about the mixture channel 8.

Figure 57:
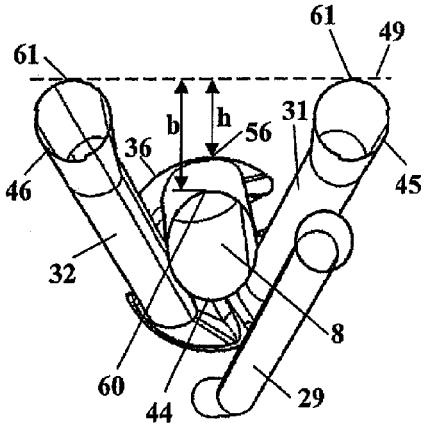
FIG. 57 is a side view of the channels in the view shown in FIG. 56 with the channels being configured in the intermediate channel of FIG. 48.
Figure 58:
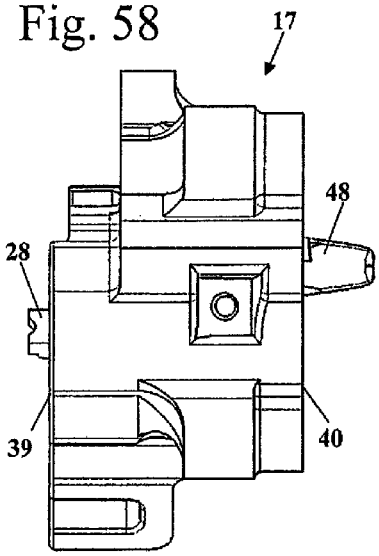
FIG. 58 is a side view of the intermediate flange in the direction of arrow LVIII of FIG. 56.

As FIG. 59 shows, the upper ends 61 of the outlet windows 45 and 46 (in FIG. 59, only the outlet window 46 is visible) are significantly above the upper end 56 of the inlet window 36 in the mixture channel 8. The imaginary plane 49, in which the upper ends 61 of the outlet window 46 lies, is at a distance (h) to the upper end 56 of the inlet window 36 in the mixture channel 8. The plane 49 runs perpendicularly to the carburetor connecting surface 39. The distance (h) is measured perpendicularly to the plane 49. The distance (h) advantageously amounts to approximately 10% to approximately 50% of the diameter (g) of the intake channel in the carburetor connecting surface 39. The distances (b) and (h) are also shown in FIG. 57. As FIG. 59 shows, the lower end 63 of the outlet windows 45 and 46 lie in an imaginary plane 79 wherein the upper end 56 of the inlet window 36 in the mixture channel 8 also lies. The imaginary plane 79 is at a distance (n) to the imaginary plane 51 and this distance (n), in the embodiment shown, amounts advantageously to approximately 5% to approximately 30% of the diameter (g) of the intake channel 21.

Figure 63:
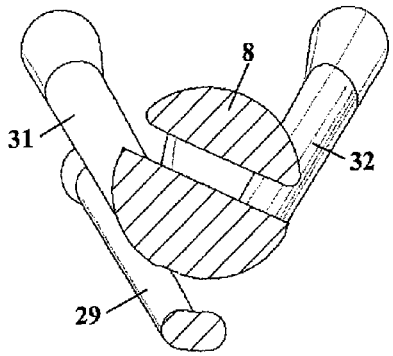
Figure 64:
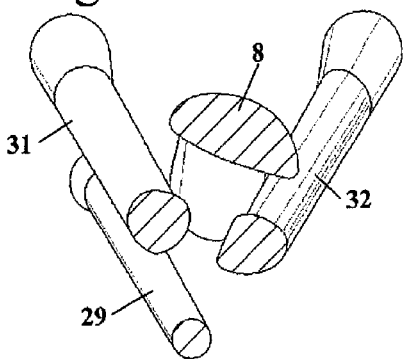
Figure 65:
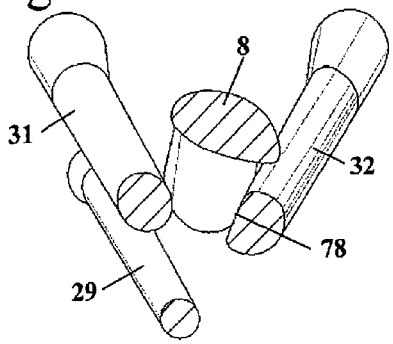
Figure 66:
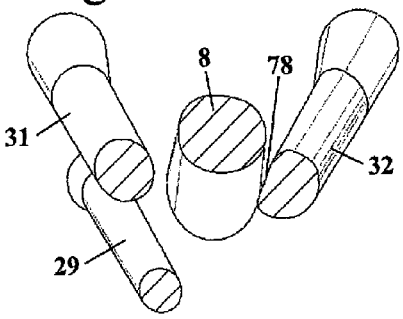
Figure 67:
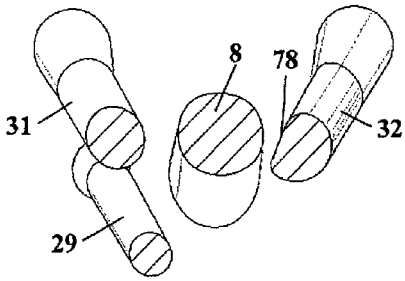
Figure 68:
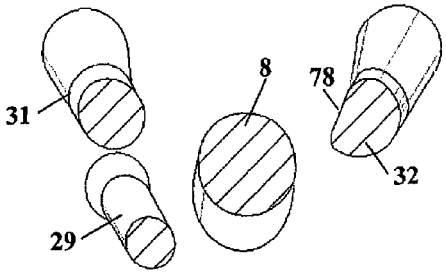
Figure 69:
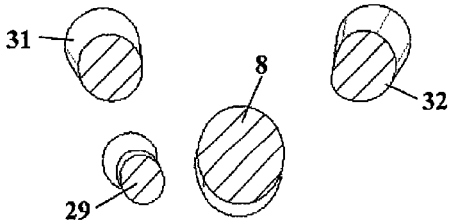

FIGS. 63 to 69 show sections through the intermediate flange 17. Only the channels 8, 9 and 29 are shown. As FIGS. 63 and 64 show, the air channel 9 partitions downstream of the carburetor connecting surface 39 into two branches 31 and 32. The distances (e) and (f) of the bifurcation 55 to the carburetor connecting surface 39 and to the cylinder connecting surface 40 are shown in FIG. 59. The distance (e) amounts here advantageously to less than the distance (f). The distance (e) amounts advantageously to less than half, especially to less than one third of the distance (f). As FIGS. 64 to 69 show, the branch 32 has a flattening 78 at its end facing toward the mixture channel 8. In the embodiment, the flattening 78 extends approximately over the entire length of the second branch 32. The flattening 78 extends over the total middle section of the second branch 32. The middle section of the second branch 32 is the region in which the second branch 32 runs uniformly cylindrically or uniformly slightly conically. Advantageously, all channels in the intermediate flange are configured slightly conically so that the intermediate flange 17 can be produced in a casting process, advantageously in a plastic injection molding process. As FIG. 69 shows, the cross section shape of the second branch 32 passes over into a circularly-shaped cross section directly ahead of the cylinder connecting surface 40. Because of the flattening 78, the second branch 32 of the air channel 9 can be led past close to the mixture channel 8. The cross section of the second branch 32 corresponds to a circle flattened on the end facing toward the mixture channel 8.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder having a cylinder bore and defining a cylinder longitudinal axis;

a piston mounted in said cylinder to move back and forth therein;

said piston delimiting a combustion chamber formed in said cylinder;

a crankcase connected to said cylinder;

a transfer channel for connecting said crankcase to said combustion chamber at bottom dead center of said piston;

an intake channel;

an intake arrangement including a carburetor containing a portion of said intake channel;

said intake channel dividing into a mixture channel and an air channel;

said carburetor including a throttle element mounted therein for controlling the free flow cross section of said intake channel;

an intermediate flange connecting said carburetor to said cylinder;

said mixture channel and said air channel being guided in said intermediate flange;

said intermediate flange having a carburetor connecting surface facing toward said carburetor and a cylinder connecting surface facing toward said cylinder;

said air channel bifurcating into first and second branches in said intake channel upstream from said cylinder connecting surface referred to the flow direction in said intake channel;

said first and second branches opening with respective air inlet openings at said cylinder bore;

said first branch defining a first longitudinal center axis and said second branch defining a second longitudinal center axis;

said first longitudinal center axis intersecting said carburetor connecting surface at a first intersect point and said cylinder connecting surface at a second intersect point;

said second longitudinal center axis intersecting said carburetor connecting surface at a third intersect point and said cylinder connecting surface at a fourth intersect point;

a first connecting line connecting said second intersect point with said fourth intersect point in said cylinder connecting surface;

a second connecting line connecting said first intersect point with said third intersect point in said carburetor connecting surface;

said first connecting line being projected perpendicularly onto said carburetor connecting surface to define a projected first connecting line; and, said projected first connecting line and said second connecting line conjointly defining an angle (β) greater than 0°.

2. The two-stroke engine of claim 1, wherein said angle (β) lies in a range from approximately 5° to approximately 60°.

3. The two-stroke engine of claim 1, wherein said angle (β) lies in a range from approximately 10° to approximately 40°.

4. The two-stroke engine of claim 1, wherein said combustion chamber has a combustion chamber roof defining a combustion chamber roof center; and, said first and second branches have respectively different average lengths (c, d) from said carburetor connecting surface to said cylinder connecting surface.

5. The two-stroke engine of claim 4, wherein one of said branches has an end which lies facing toward said carburetor connecting surface; and, said one branch lies with said end thereof closer to said combustion chamber roof center than the other one of said branches.

6. The two-stroke engine of claim 1, wherein said air channel bifurcates into said first and second branches in said intermediate flange.

7. The two-stroke engine of claim 6, wherein said air channel bifurcates at a bifurcation; and, said bifurcation is at a distance (e) to said carburetor connecting surface which is less than a distance (f) to said cylinder connecting surface.

8. The two-stroke engine of claim 7, wherein said distance (e) to said carburetor connecting surface is less than half said distance (f) to said cylinder connecting surface.

9. The two-stroke engine of claim 1, wherein at least one of said branches has a flattened cross section next to said mixture channel.

10. The two-stroke engine of claim 1, wherein said intake channel has an approximately circularly-shaped cross section at said carburetor connecting surface.

11. The two-stroke engine of claim 1, wherein said intake channel is partitioned into said air channel and said mixture channel in said carburetor connecting surface; and, an inlet window is provided in said mixture channel and an inlet window is provided in said air channel in said carburetor connecting surface.

12. The two-stroke engine of claim 11, wherein said combustion chamber has a combustion chamber roof defining a roof center; and, said inlet window in said mixture channel lies closer to said roof center than said inlet window of said air channel.

13. The two-stroke engine of claim 12, wherein said inlet window of said air channel and said inlet window of said mixture channel have respective flow cross sections; and, said flow cross section of said air channel is larger than said flow cross section of said mixture channel.

14. The two-stroke engine of claim 13, wherein said transfer channel is a first transfer channel and wherein said two-stroke engine has a second transfer channel; said two-stroke engine has a center plane containing said cylinder longitudinal axis; said first and second transfer channels are configured to be symmetrical to said center plane; said inlet window of said air channel and said inlet window of said mixture channel are separated from each other in a partition plane; and, said partition plane and said center plane conjointly define an angle ($\alpha$) of less than 90°.

15. The two-stroke engine of claim 14, wherein said angle ($\alpha$) lies in a range from approximately 50° to approximately 80°.

16. The two-stroke engine of claim 14, wherein said angle ($\alpha$) lies in a range from approximately 60° to approximately 70 °.

17. The two-stroke engine of claim 1, wherein said first and second branches and said mixture channel have respective mutually separate outlet windows opening in said cylinder connecting surface.

18. The two-stroke engine of claim 17, wherein said transfer channel is a first transfer channel and wherein said two-stroke engine has a second transfer channel; said two-stroke engine has a center plane containing said longitudinal center axis; said first and second transfer channels are configured to be symmetrical to said center plane; and, said mutually separate outlet windows are arranged symmetrically to said center plane at said cylinder connecting surface.

19. The two-stroke engine of claim 18, wherein said combustion chamber has a combustion chamber roof defining a roof center; and, at least one of said outlet windows of said first and second branches is closer to said roof center than the outlet window of said mixture channel.

20. The two-stroke engine of claim 1, wherein at least one side view transverse to the flow direction in said intake channel shows at least one of said first and second branches in crossover relative to said mixture channel.

21. The two-stroke engine of claim 1, wherein said two-stroke engine further comprises a pulse channel guided in said intermediate flange.

22. The two-stroke engine of claim 21, wherein said pulse channel in said intermediate flange runs parallel to one of said first and second branches of said air channel.

* * * * *